US008939482B2

(12) United States Patent
Rasmussen et al.

(10) Patent No.: US 8,939,482 B2
(45) Date of Patent: Jan. 27, 2015

(54) SUPPORT SYSTEM FOR DIGITAL TABLET DEVICES

(71) Applicants: Kara Megan Rasmussen, Aurora, OH (US); Steven Frank Rasmussen, Aurora, OH (US)

(72) Inventors: Kara Megan Rasmussen, Aurora, OH (US); Steven Frank Rasmussen, Aurora, OH (US)

(73) Assignees: Kara M. Rasmussen, Aurora, OH (US); Steven F. Rasmussen, Aurora, OH (US)

( * ) Notice: Subject to any disclaimer, the term of this patent is extended or adjusted under 35 U.S.C. 154(b) by 0 days.

(21) Appl. No.: 14/031,859

(22) Filed: Sep. 19, 2013

(65) Prior Publication Data

US 2014/0077515 A1 Mar. 20, 2014

Related U.S. Application Data

(60) Provisional application No. 61/702,791, filed on Sep. 19, 2012.

(51) Int. Cl.

| | |
|---|---|
| ***B65G 7/12*** | (2006.01) |
| ***A45F 5/10*** | (2006.01) |
| ***A45F 5/00*** | (2006.01) |

(52) U.S. Cl.

CPC . *A45F 5/102* (2013.01); *A45F 5/00* (2013.01); *A45C 2200/15* (2013.01); *A45F 2005/008* (2013.01); *A45F 2200/0516* (2013.01); *A45F 2200/0525* (2013.01); *Y10S 224/93* (2013.01)

USPC ..... 294/25; 224/218; 224/930

(58) Field of Classification Search

USPC ..... 294/25, 27.1, 31.2, 137, 139, 150, 219; 401/6–8, 48; 224/217–219, 197, 930; 248/444, 450, 682, 688; 206/305, 320, 206/576; 455/575.1, 575.8, 128; 361/679.3, 361/679.55, 679.03, 679.56, 679.58

See application file for complete search history.

(56) References Cited

U.S. PATENT DOCUMENTS

| | | | | |
|---|---|---|---|---|
| 2,876,022 | A | 3/1959 | Kroviak | |
| 5,810,220 | A | 9/1998 | Petersen | |
| 6,009,600 | A * | 1/2000 | Egeland et al. | 16/436 |
| 6,016,248 | A | 1/2000 | Anzai et al. | |
| 6,016,942 | A | 1/2000 | Allen | |
| 6,116,484 | A | 9/2000 | Allen | |
| 6,161,740 | A | 12/2000 | Allen | |
| 6,360,928 | B1 * | 3/2002 | Russo | 224/218 |
| 6,726,070 | B2 | 4/2004 | Lautner | |
| 7,434,969 | B2 * | 10/2008 | Ford et al. | 362/382 |
| 7,469,809 | B2 | 12/2008 | Rodarte et al. | |
| 7,726,070 | B2 | 6/2010 | Thrash | |
| 7,764,488 | B2 * | 7/2010 | Calvarese | 361/679.03 |
| 8,136,780 | B2 | 3/2012 | Lin | |
| D657,795 | S | 4/2012 | Smith et al. | |
| D673,162 | S * | 12/2012 | Young | D14/447 |

(Continued)

FOREIGN PATENT DOCUMENTS

| | | | |
|---|---|---|---|
| EP | 2390548 | A1 | 11/2011 |
| WO | 2012087371 | A1 | 6/2012 |

*Primary Examiner* — Stephen Vu

(74) *Attorney, Agent, or Firm* — Tucker Ellis LLP

(57) ABSTRACT

A grippable support apparatus functions as a combination support stand and carrying handle for portable electronic devices. The apparatus includes a base member, an attachment member for attaching the base member with a rear surface of the table device, and an interface configured to be gripped by the hand of an associated user for carrying the tablet device from place to place. The interface includes first and second interface members configured to engage a ventral side and a dorsal side, respectively, of the hand of the user.

29 Claims, 19 Drawing Sheets

(56) References Cited

U.S. PATENT DOCUMENTS

| | | | | |
|---|---|---|---|---|
| 2003/0213822 | A1 | 11/2003 | Lautner | |
| 2004/0226973 | A1 | 11/2004 | Kao | |
| 2006/0226032 | A1* | 10/2006 | Zalsman | 206/63.5 |
| 2011/0240448 | A1 | 10/2011 | Springer et al. | |
| 2011/0240830 | A1 | 10/2011 | Alemozafar et al. | |
| 2011/0247959 | A1 | 10/2011 | Nelson | |
| 2011/0267748 | A1 | 11/2011 | Lane et al. | |
| 2011/0279959 | A1 | 11/2011 | Lopez | |
| 2011/0299231 | A1 | 12/2011 | Gaddis, II et al. | |
| 2011/0303578 | A1 | 12/2011 | Mizell et al. | |
| 2011/0303709 | A1 | 12/2011 | Wizikowski | |
| 2012/0019016 | A1 | 1/2012 | Brisbin | |
| 2012/0024918 | A1 | 2/2012 | DeCamp et al. | |
| 2012/0025684 | A1 | 2/2012 | Trotsky | |
| 2012/0026854 | A1 | 2/2012 | Umezawa et al. | |
| 2012/0031937 | A1* | 2/2012 | Baker | 224/217 |
| 2012/0048873 | A1 | 3/2012 | Hyseni | |
| 2012/0063066 | A1 | 3/2012 | Floit | |
| 2012/0068043 | A1 | 3/2012 | Daigle et al. | |
| 2012/0075799 | A1 | 3/2012 | Pollex | |
| 2012/0080577 | A1 | 4/2012 | McIntyre et al. | |
| 2012/0091312 | A1 | 4/2012 | Baker | |
| 2012/0097831 | A1 | 4/2012 | Olukotun et al. | |
| 2012/0100398 | A1 | 4/2012 | Lee | |
| 2012/0104059 | A1 | 5/2012 | Yen | |
| 2012/0104185 | A1 | 5/2012 | Carroll | |
| 2012/0111881 | A1 | 5/2012 | Gaddis, II et al. | |
| 2012/0118770 | A1* | 5/2012 | Valls et al. | 206/320 |
| 2012/0161406 | A1 | 6/2012 | Mersky | |
| 2012/0168481 | A1 | 7/2012 | Casagrande | |
| 2012/0187260 | A1 | 7/2012 | Moyer | |
| 2012/0187706 | A1 | 7/2012 | Kannaka | |
| 2012/0200102 | A1 | 8/2012 | McMeans | |
| 2012/0224318 | A1 | 9/2012 | Carleton | |
| 2012/0228346 | A1 | 9/2012 | Huang | |
| 2012/0235001 | A1 | 9/2012 | Somuah | |
| 2012/0246879 | A1 | 10/2012 | Pestal et al. | |
| 2012/0261520 | A1 | 10/2012 | Groomes et al. | |
| 2013/0300141 | A1* | 11/2013 | Byrne | 294/25 |

* cited by examiner

SUPPORT SYSTEM FOR DIGITAL TABLET DEVICES

CROSS-REFERENCE TO RELATED APPLICATION

This application claims the benefit of U.S. Provisional Application No. 61/702,791, filed on Sep. 19, 2012, the contents of which are included herein by reference.

TECHNICAL FIELD

The present disclosure relates to accessories for portable tablet devices and will be described with particular reference thereto. However, it will be appreciated that the embodiments herein will find application for use with any portable electronic devices.

BACKGROUND

By their very nature, tablet devices such as iPad™ devices of Apple, Kindle™ devices of Amazon, Nook™ devices of Barnes & Noble, Galaxy™ devices of Samsung, and the like, are portable. Users therefore often carry the tablet devices from place to place. It is important, however, that the users not drop the tablet devices as they are somewhat fragile. The smooth outer casings and interface screen of the tablet devices make them hard to carry without first placing them into a carrying bag or the like.

Users desire to interface with the portable tablet devices from place to place including for example with the devices being placed onto horizontal work surfaces such as tables, countertops, desks or the like. However, flat horizontal positioning of the portable tablet devices often makes viewing the screens thereof difficult. It is important, therefore, to be able to support the devices at selected angles relative to the work surfaces for ease of use of the devices.

BRIEF DESCRIPTION OF THE DRAWINGS

The accompanying drawings incorporated herein and forming a part of this specification illustrate example embodiments.

OVERVIEW OF EXAMPLE EMBODIMENTS

Figure 1:
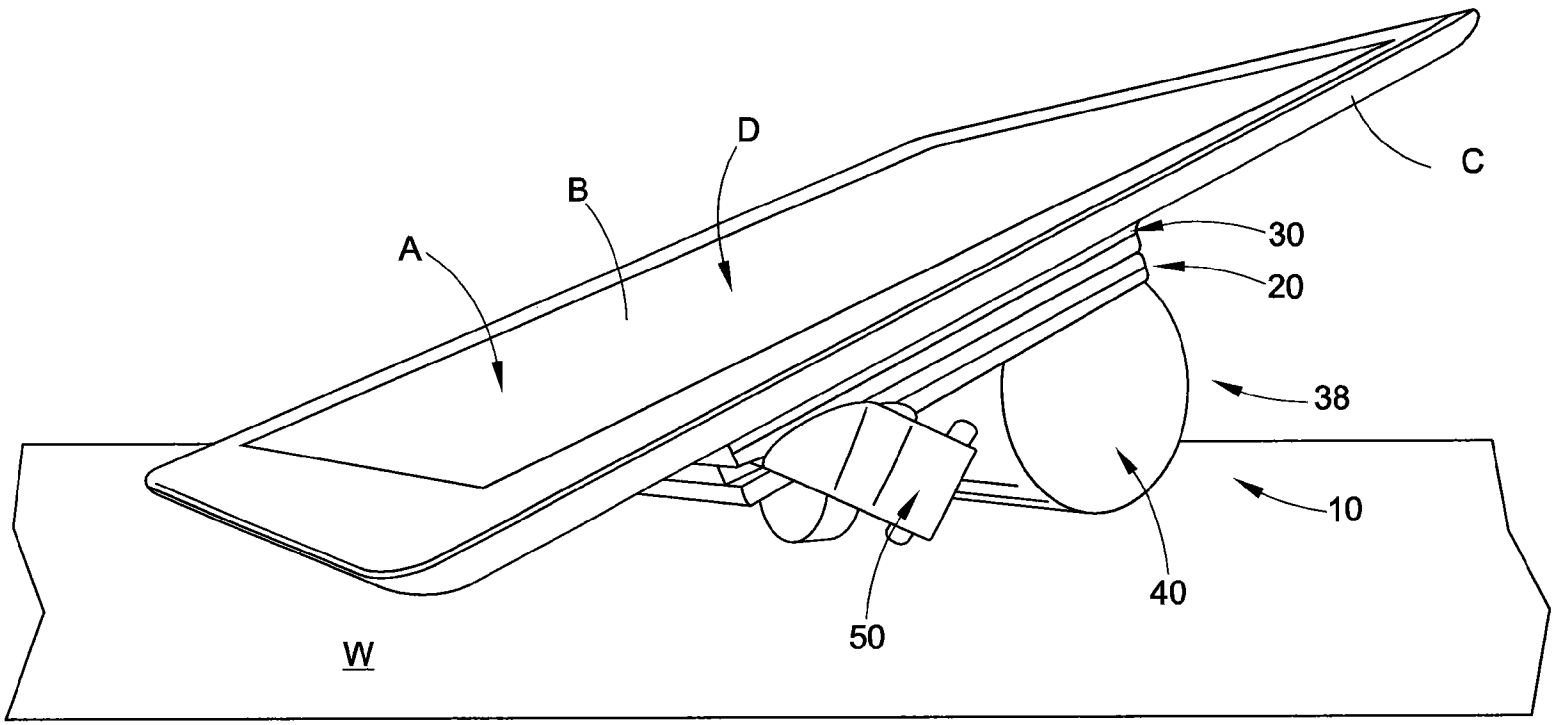
FIG. 1 is a side perspective view of a grippable support apparatus in accordance with an example embodiment supporting an associated tablet device in a first orientation.

In accordance with the example embodiments described herein, a grippable support apparatus is provided for use with an associated tablet device having a generally rectangular conformation with opposite front and rear substantially planar surfaces. The apparatus of an example embodiment includes a base member, an attachment member, and a user interface portion comprising first and second interface members. The attachment member selectively attaches the base member with the rear substantially planar surface of the associated tablet device. The first interface member is operatively coupled with the base member and is configured to engage a ventral side of the hand of a user of the grippable support apparatus. The second interface member is operatively coupled with the base member and is configured to engage a dorsal side of the hand of the user of the grippable support apparatus.

Further in accordance with the example embodiments, the first interface member of the grippable support apparatus of the example embodiment comprises an elongate cylindrical member coupled with the base member. The elongate cylindrical member is configured to be gripped by the hand of the user of the apparatus, and the second interface member comprises an elongate band member coupled with the base member. The elongate band member is configured to surround the dorsal side of the hand of the user of the apparatus and to hold the hand of the user between the elongate band member and the elongate cylindrical member.

Still further in accordance with the example embodiments described herein the attachment member may comprise any form of method or apparatus for selectively attaching the base member with the rear substantially planar surface of the associated tablet device including for example any one or more of a fastener, a suction cup, an adhesive, a magnetic member or one or more clip members operatively coupled with the base member. In one embodiment, the attachment member comprises at least one suction cup member operatively coupled with the base member. The suction cup member is configured to selectively attach the base member with the rear substantially planar surface of the associated tablet device. In another embodiment, the attachment member comprises adhesive tape operatively coupled with the base member. The adhesive tape is configured to selectively attach the base member with the rear substantially planar surface of the associated tablet device. In a further embodiment, the attachment member comprises a magnetic member operatively coupled with the base member. The magnetic member is configured to selectively attach the base member with the rear substantially planar surface of the associated tablet device. In a still further embodiment, the attachment member comprises at least two clip members operatively coupled with the base member, wherein each of the at least two clip members is configured to engage an edge on opposite sides of the associated tablet device defined between the opposite front and rear substantially planar surfaces of the associated tablet device.

Still further in accordance with the example embodiments described herein, the base member comprises a first block member operatively coupled with the attachment means, a second block member operatively coupled with the first and second interface members, and a joint member mutually rotatably coupling the first and second block members.

DESCRIPTION OF EXAMPLE EMBODIMENTS

With reference to the drawing figures, wherein the showings are for illustrating the example embodiments only, and not for purposes of limiting the claims herein, FIG. 1 shows a side perspective view of a grippable support apparatus 10 in accordance with an example embodiment. The apparatus 10 is shown together with an associated tablet device A having a generally rectangular conformation with opposite front B and back C substantially planar surfaces. It is to be appreciated that the associated tablet device A forms no part of the example embodiment but is shown in the drawings herein only for purposes of helping to facilitate the description of the apparatus 10 of the example embodiment.

In general, the grippable support apparatus 10 includes a base member 20 and an attachment member 30 wherein the attachment member 30 selectively attaches the base member 20 with the rear substantially planar surface C of the associated tablet device A.

In addition to the above, the grippable support apparatus 10 of the example embodiment includes a user interface portion 38 comprising first and second interface members 40, 50 generally arranged relative to the base member 20 and attachment member 30 in the relative positions illustrated. In the example embodiment, the first and second interface members 40, 50 are operatively coupled with the base member 20 as will be described in greater detail below. As can be seen from the showing of FIG. 1, the grippable support apparatus 10 of the example embodiment is functional to provide a support system for propping the associated tablet device A in selected positions relative to an associated work surface W for convenient use of the table device A such as for viewing a display screen D thereof or for entering data into the tablet device such as by typing information into the display screen at representations of a key pad or the like.

Figure 2:
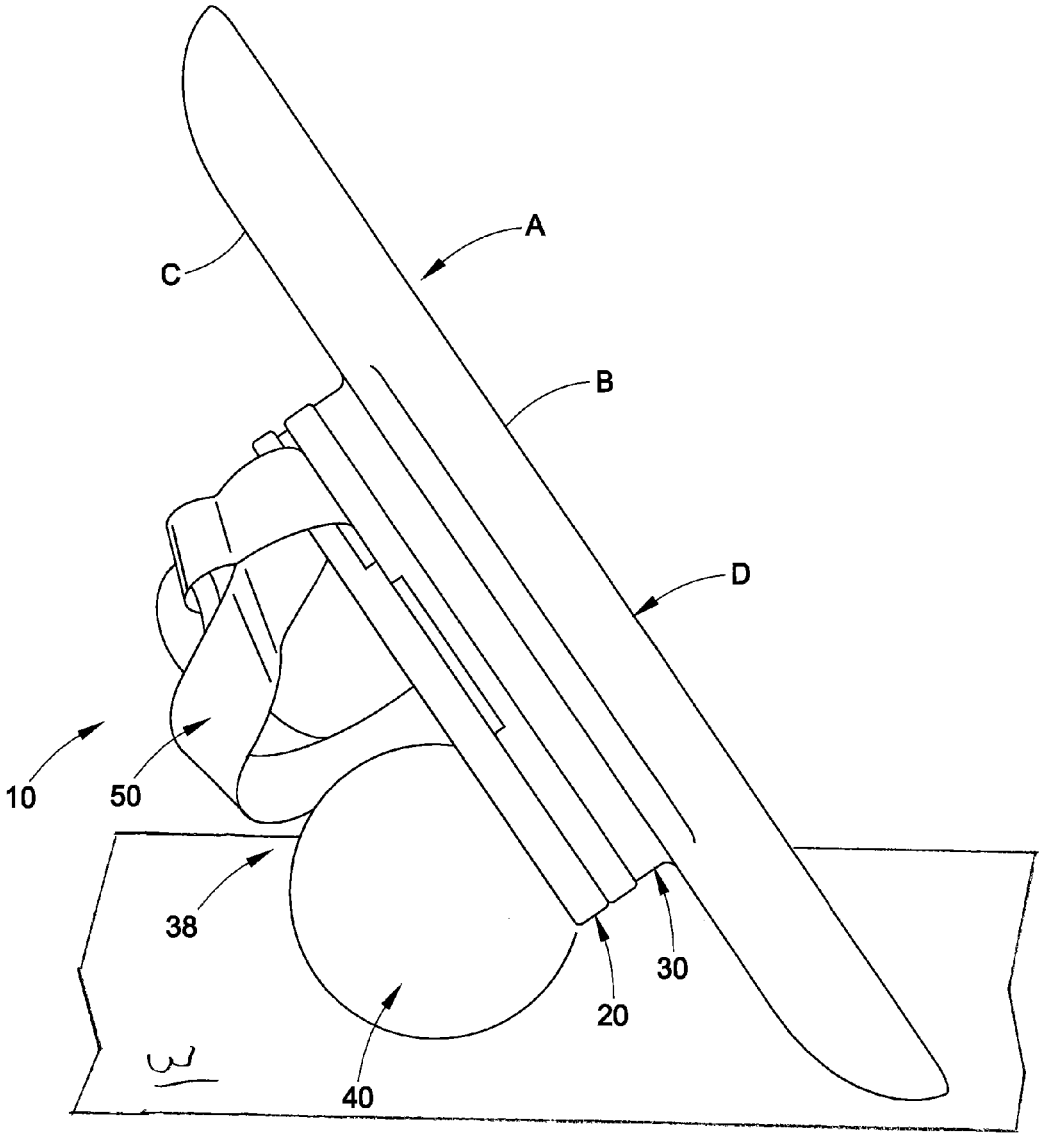
FIG. 2 is a side perspective view of a grippable support apparatus in accordance with an example embodiment supporting an associated tablet device in a second orientation.

It is to be appreciated that in accordance with the example embodiments described herein, the subject grippable support apparatus 10 is easily carried by hand while attached with the associated tablet device and is further movable into selected positions relative to the associated tablet device A so that the tablet device can be positioned in several orientations relative to the associated work surface W such as shown, for example, in the orientations illustrated in FIGS. 1 and 2. More particularly, in the orientation shown in FIG. 1, the front surface B of the associated tablet device A is held at an angle of approximately 23 degrees relative to the associated work surface W. This orientation makes it very convenient to type into the device. In the orientation shown in FIG. 2, the front surface B of the associated tablet device A is held at an angle of approximately 45 degrees relative to the associated work surface W. This orientation makes it very convenient to watch streaming video or the like rendered on the display screen D of the tablet device.

Figure 3:
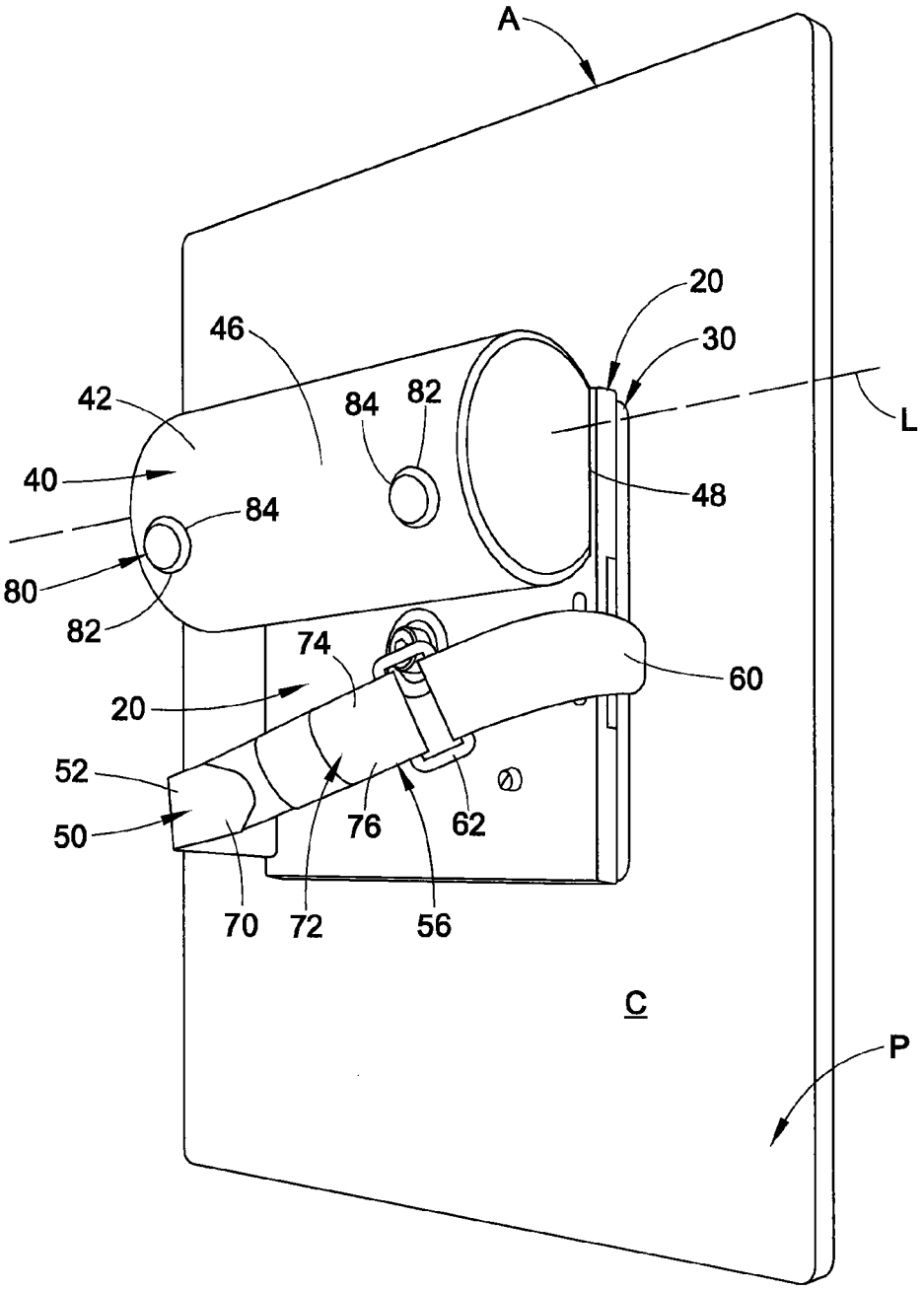
FIG. 3 is a rear perspective view of a grippable support apparatus in accordance with an example embodiment supporting an associated tablet device.
Figure 4:
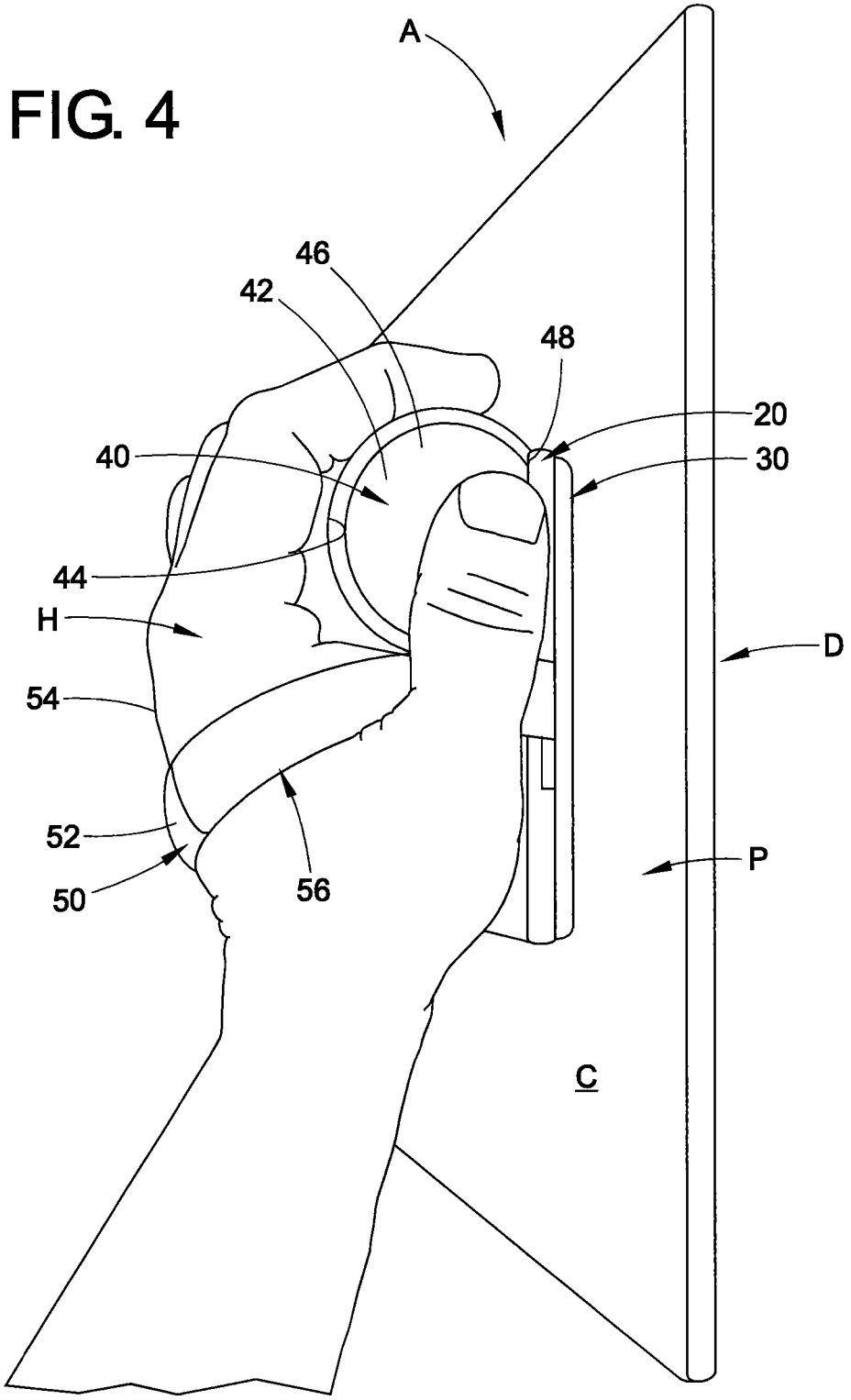
FIG. 4 is a side perspective view of the grippable support apparatus shown in FIG. 3 and illustrating the apparatus being held by a hand of an associated user.

Turning next to FIGS. 3 and 4, an embodiment of the subject grippable support apparatus 10 is illustrated without (FIG. 3) and with (FIG. 4) the hand of an associated user of the tablet device A in an operative gripped position relative to the apparatus. As noted above, the first interface member 40 is operatively coupled with the base member 20. In the example embodiment illustrated, the first interface member is an elongate cylindrical member 42 coupled with the base member 20 in the position substantially as shown. Additionally as described above, the second interface member 50 is operatively coupled with the base member 20 and, in the example embodiment, comprises an elongate band member 52 coupled with the base member 20 substantially as shown.

The embodiments of the subject grippable support apparatus 10 conveniently assists users of the associated tablet device A to grip and carry the tablet device from place to place as necessary or desired. In addition, the support apparatus enables use of the associated tablet device by users who may grip the support apparatus 10 using a first hand and while interfacing with the display screen D of the tablet device A using the other hand. This is convenient for users who might be walking or standing or when work surfaces W (FIGS. 1 and 2) are generally unavailable.

With continued reference to FIGS. 3 and 4, it is to be appreciated that the elongate cylindrical member 42 is configured to be gripped by the hand H of an associated user of the apparatus 10. The overall cylindrical shape of the elongate member 42 generally conforms to the shape of the palm of the user's hand wherein the finger of the user's hand may curl inwardly and slightly "behind" the member 42. In particular, the elongate cylindrical member 42 is configured to engage the ventral side 44 of the hand H of the associated user. In an embodiment, the elongate cylindrical member 42 has a diameter of about two (2) inches.

In addition to the above, for purposes of helping to reduce the energy required for gripping the first interface member 40 and to help insure that the support apparatus 10 does not slip from the grasp of the user, the elongate band member 52 is configured to engage a dorsal side 54 of the hand H of the associated user. In particular, the elongate band member 52 is coupled with the base member 20 substantially as shown and is configured to surround the dorsal side 54 of the hand H of the user, wherein the band member 52 captures and holds the hand H of the user between the elongate band member 52 and the elongate cylindrical member 42.

It is to be appreciated that the elongate cylindrical member 42 generally defines a longitudinal axis L as best shown in FIG. 3. For purposes of enabling a user to easily grip the support apparatus 10 with a first hand while interfacing with the display screen D using the other hand, the longitudinal axis L defined by the elongate cylindrical member 42 is arranged to extend substantially in parallel with a plane P defined by the planar rear surface C of the associated tablet device A. The orientation of the longitudinal axis L relative to the plane P of the associated tablet device A makes the subject support apparatus 10 easily grippable and convenient to use.

The elongate cylindrical member 42 may be formed from any suitable material as necessary or desired such as, for example, plastic or wood. The plastic or wood portion of the device can easily be replaced with a medium density polystyrene foam. This would add to the comfort of the device. The foam mold would also be lighter than the plastic or wood round. To retain the anti-fatigue element of the device, the curvature of member 42 and the fingertip allowance at the front of the round member 42 is maintained regardless of the material used. When switching to the polystyrene foam, the height of the round member 42 is also preferably maintained so the tablet will have the same great viewing angles when positioned on the associated work surface W. The medium density polystyrene can be bonded to an outer high wicking fabric or rubber coating. This would allow sweat to be swept away from the underside of the user's hand, and quickly evaporated. The fabric or rubber coating can be a colorful addition to the device.

Lastly, with regard to FIGS. 3 and 4, as shown, the elongate cylindrical member 42 has a substantially circular cross-section to be easily grasped by hand and, accordingly, is in its preferred form an elongate circular cylindrical member 46. In the embodiment illustrated, however, the circular cylindrical member 46 includes a substantially planar surface 48 formed along the longitudinal access L of the interface member 40 wherein the planar surface 48 provides a convenient attachment surface for operative connection with the base member such as by using suitable fasteners, glues, or the like. Further, for purposes of accommodating hands H of varied sizes, the elongate band member 52 of the example embodiment illustrated is a strap member 56, preferably having an adjustable length. To that end, the strap member 56 includes a first free end 60 carrying a loop member 62 thereon. A second portion 70 of the strap member 56 includes a free end 72 carrying on a first side thereof loops and, on the second side thereof, hooks 76 interoperable with the loops 74 for connecting the free end 72 upon itself. The second portion 70 of the strap member 56 is configured to pass through the loop member 62 described above and the hooks 76 and loops 74 are configured to selectively mutually adhere to each other to complete the connection.

With yet still further reference to FIG. 3, the elongate cylindrical member 42 of the grippable support apparatus of the example embodiment carries a foot member 80 configured to engage an associated work surface W supporting the associated tablet device A such as shown, for example, in FIGS. 1 and 2. In the example embodiment, the foot member 80 comprises a pair of circular cushions 82 having a coefficient of friction selected to enable the subject support apparatus 10 to sit upon the associated work surface W and to be exercised by the associated user without the tablet device A sliding relative to the work surface W. In this way, the foot member 80 provides an enhanced friction interface between the support apparatus 10 and the associated work surface W. As illustrated, the circular cushions 82 comprise a pair of rubber pads 84 having a selected coefficient of friction relative to the work surface W.

Figure 5:
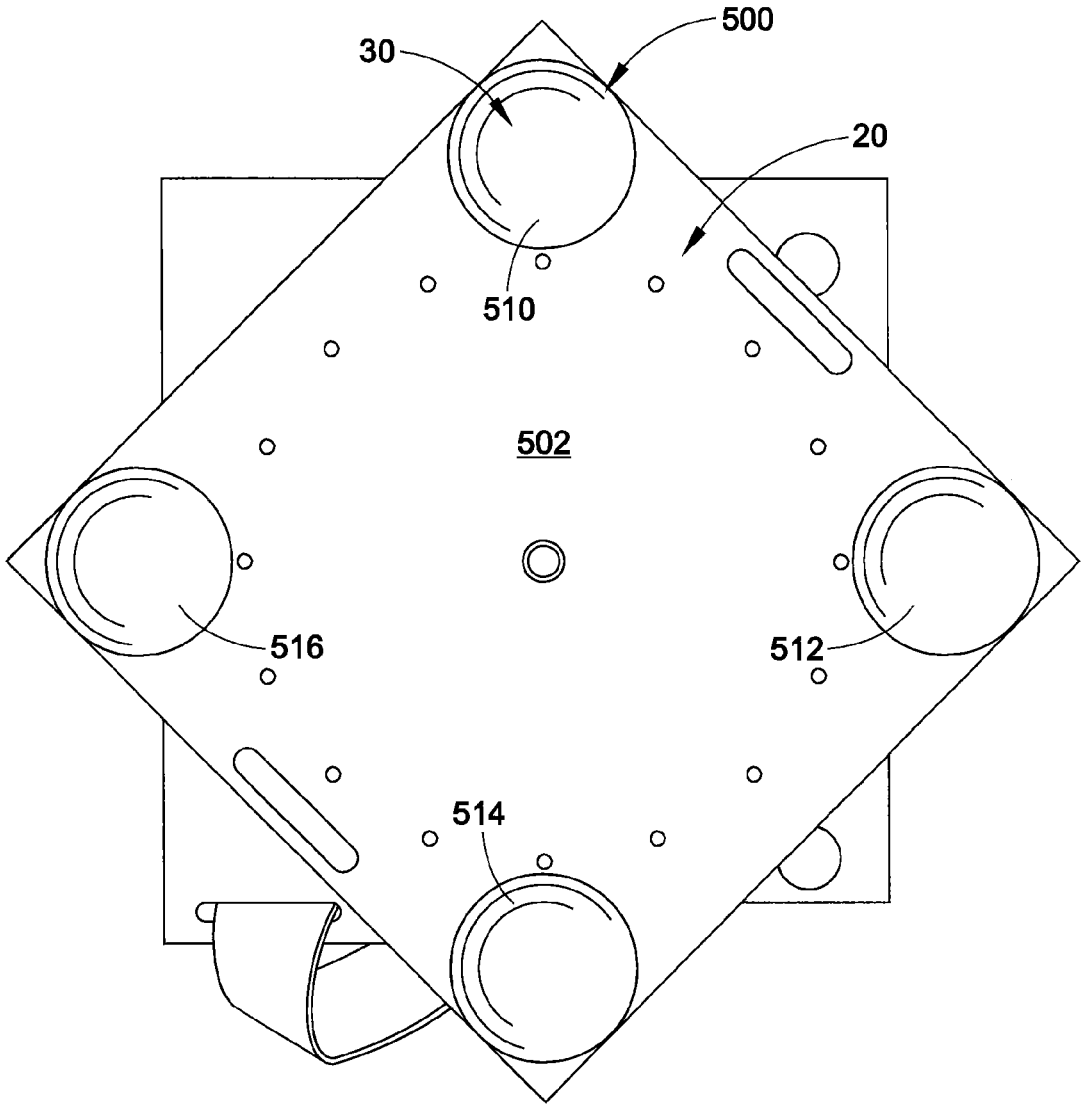
FIG. 5 is a bottom plan view of an attachment member of a grippable support apparatus in accordance with an example embodiment.

The base member 20 may be selectively attached with the rear substantially planar surface C of the associated tablet device A using any attachment means as may be necessary or desired. In this connection, in accordance with an example embodiment, the attachment member 30 comprises at least one suction cup member 500 disposed on a bottom side 502 of the base member 20 as best shown in FIG. 5. In particular, the at least one suction cup 500 includes, in the example embodiment, a set of four (4) suction cups 510, 512, 514, 516 each being disposed in opposite corners of the substantially rectangular base member 20. The suction cups 510-516 are configured for selective attachment with the rear surface C of the associated tablet device A such as shown, for example, in FIGS. 1-4.

Figure 6:
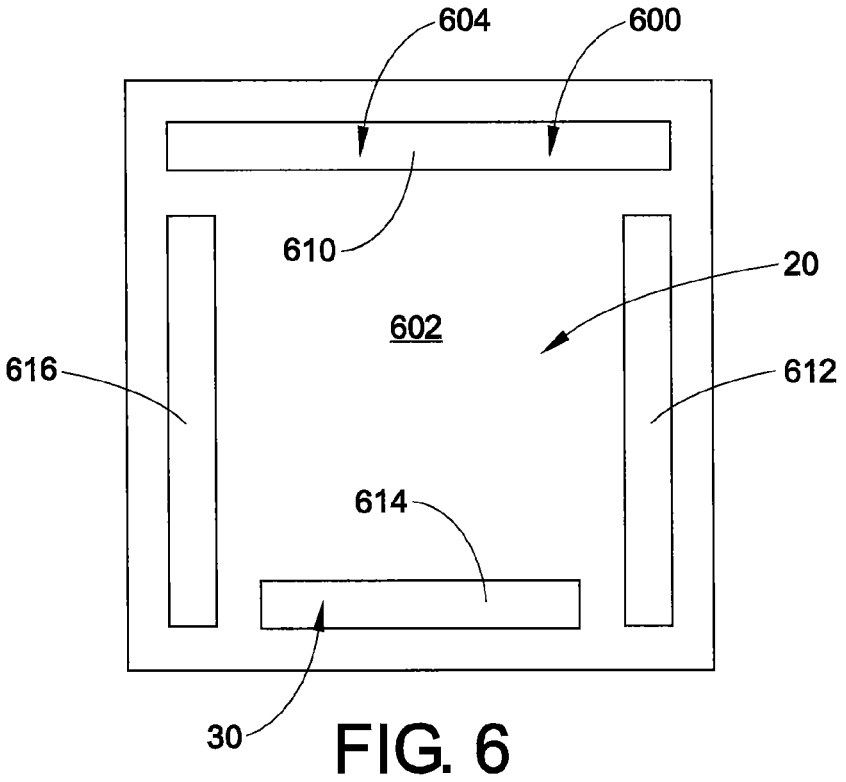
FIG. 6 is a bottom plan view of an attachment member of a grippable support apparatus in accordance with an example embodiment.

In accordance with a further example embodiment, the attachment member 30 comprises an adhesive 600 such as glue or any other suitable bonding material disposed on the bottom side 602 of the base member 20 such as shown, for example, in FIG. 6. In a particular embodiment, the adhesive 600 is one or more strips of adhesive tape 604 operatively coupled with the bottom side 602 of the base member 20. Very high bond (VHB) adhesive available from 3M has been found to be particularly well-suited for use in an embodiment. In the example embodiment illustrated, the adhesive tape 604 comprises four (4) strips of adhesive tape 610, 612, 614, 616 arranged along the edges of the substantially rectangular base member 20 as shown. The strips of adhesive tape 610-616 are configured to selectively attach the base member 20 with the rear substantially planar surface C of the associated tablet device A.

Figure 7A:
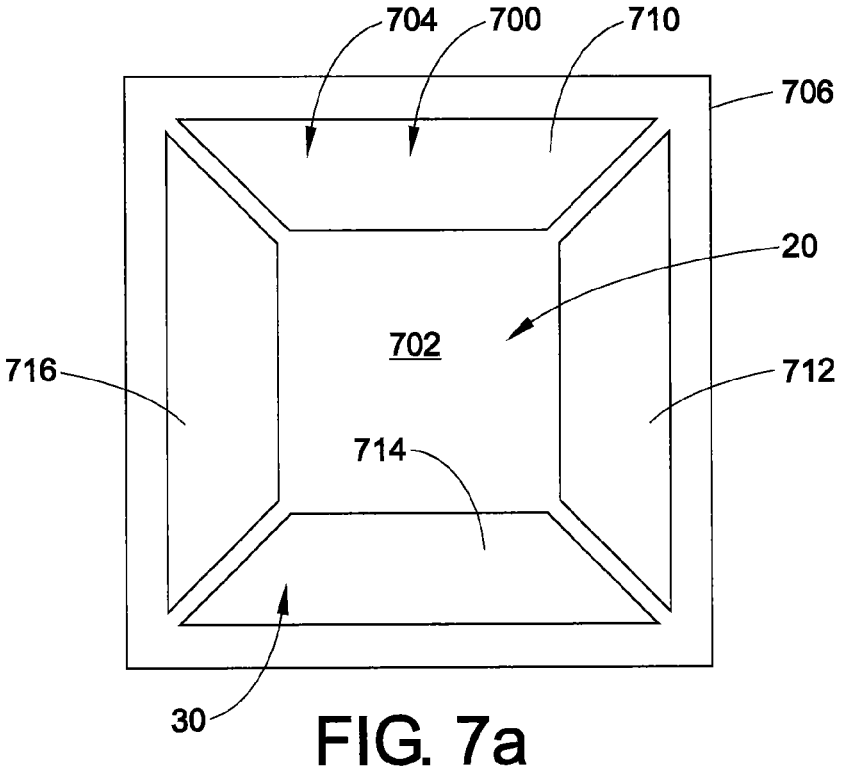
FIG. 7*a* is a bottom plan view of an attachment member of a grippable support apparatus in accordance with an example embodiment.
Figure 7B:
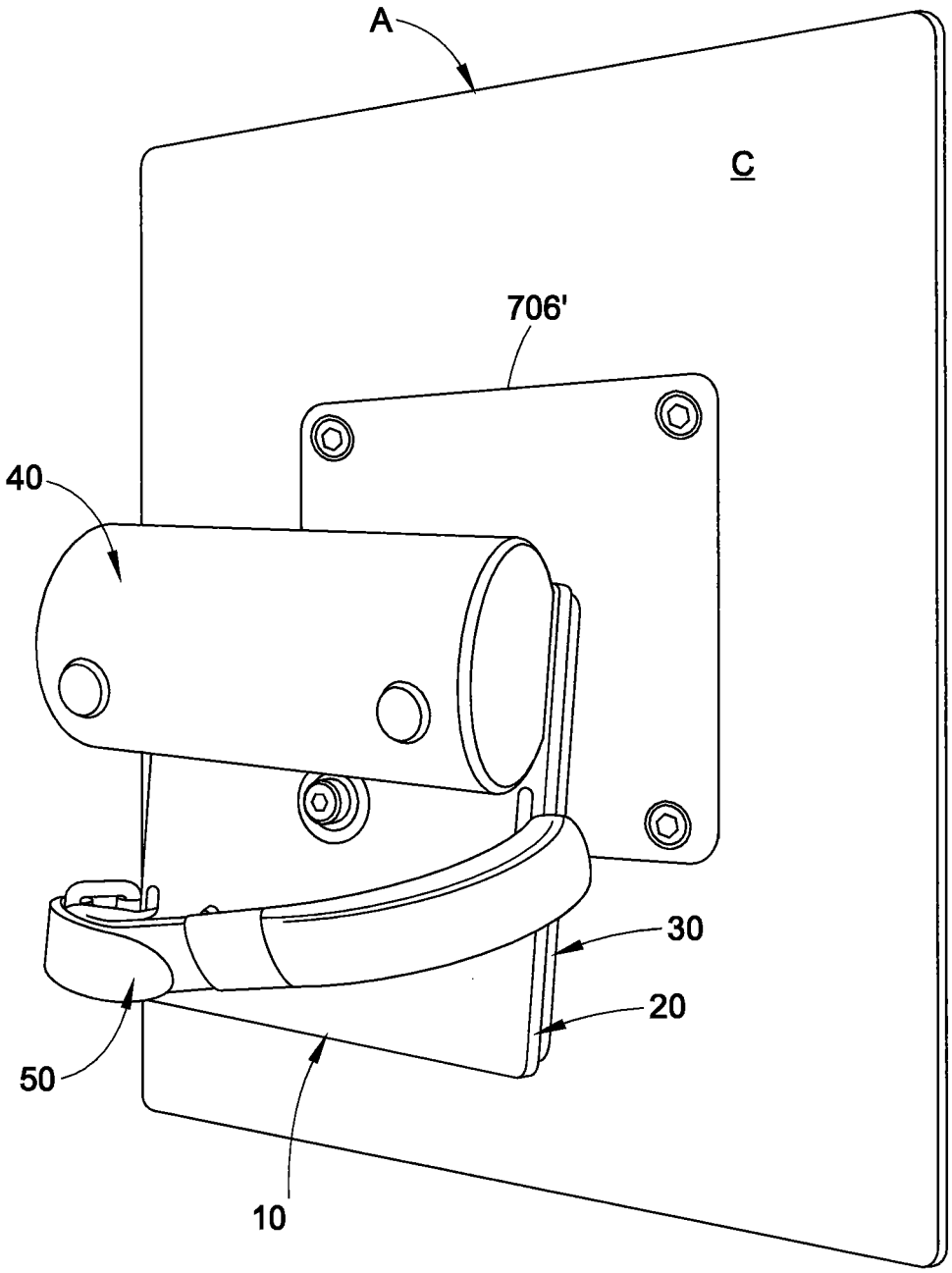
FIG. 7*b* is a rear perspective view of the attachment member of FIG. 7*a* used in a grippable support apparatus of an embodiment and illustrated adjacent an associated tablet device prior to installation.

In accordance with a further example embodiment and with reference to FIGS. 7*a* and 7*b*, the attachment member 30 comprises a magnetic member 700 operatively coupled with the bottom side 702 of the base member 20 for selectively attaching the base member with the rear substantially planar surface C of the associated tablet device A. In the embodiment illustrated, the magnetic member comprises a magnetic strip 704 arranged relative to the bottom side 702 of the base member 20 to interact with corresponding magnetic strips (not shown) disposed on or in the rear surface C of the associated tablet device A. In that way, magnetic members on the subject support apparatus 10 of the example embodiment mutually cooperate with corresponding magnetic members on or in the associated tablet device A for securing the base member relative to the tablet device. In an example embodiment, the outer extent 706 of the bottom side 702 of the base member 20 has a shape corresponding to one or more indentations or raised surfaces on the rear surface C of the associated tablet device A so that the bottom side 702 of the base member 20 may seat into the recesses 706' and/or raised portions such as, for example, ridges or the like assisting in preventing detachment of the base member 20 from the tablet device owing to shear forces or the like. In the illustrated example, the magnetic strip 704 comprises a plurality of magnetic strips 710, 712, 714, 716 arranged along the edge of the bottom side 702 of the base member 20. In that example embodiment, the magnetic number 700 comprises a rare earth magnet. Other magnets may be used as well.

Figure 8A:
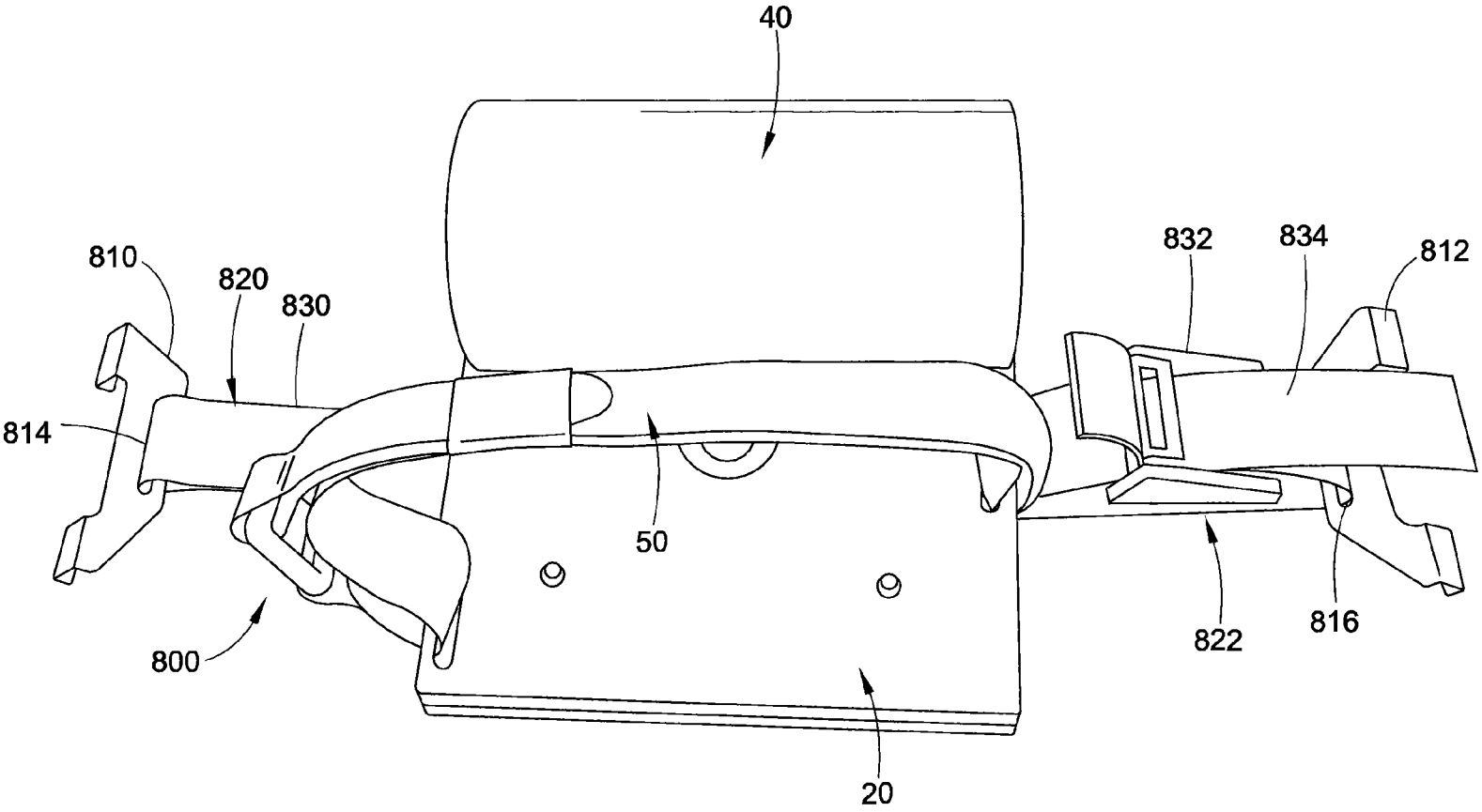
FIGS. 8*a* and 8*b* are front and rear perspective views of an attachment member of a grippable support apparatus in accordance with an example embodiment.
Figure 8B:
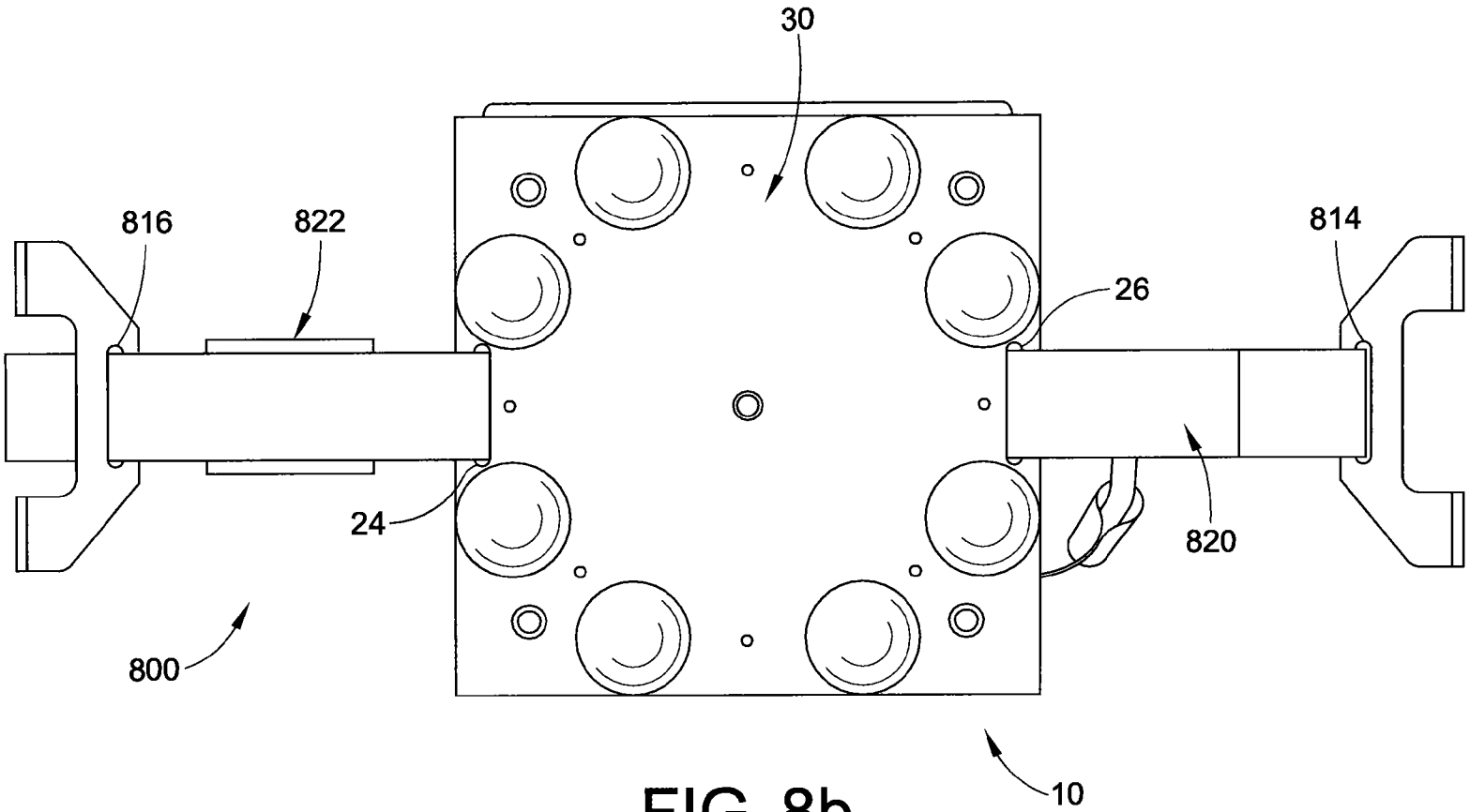
Figure 9A:
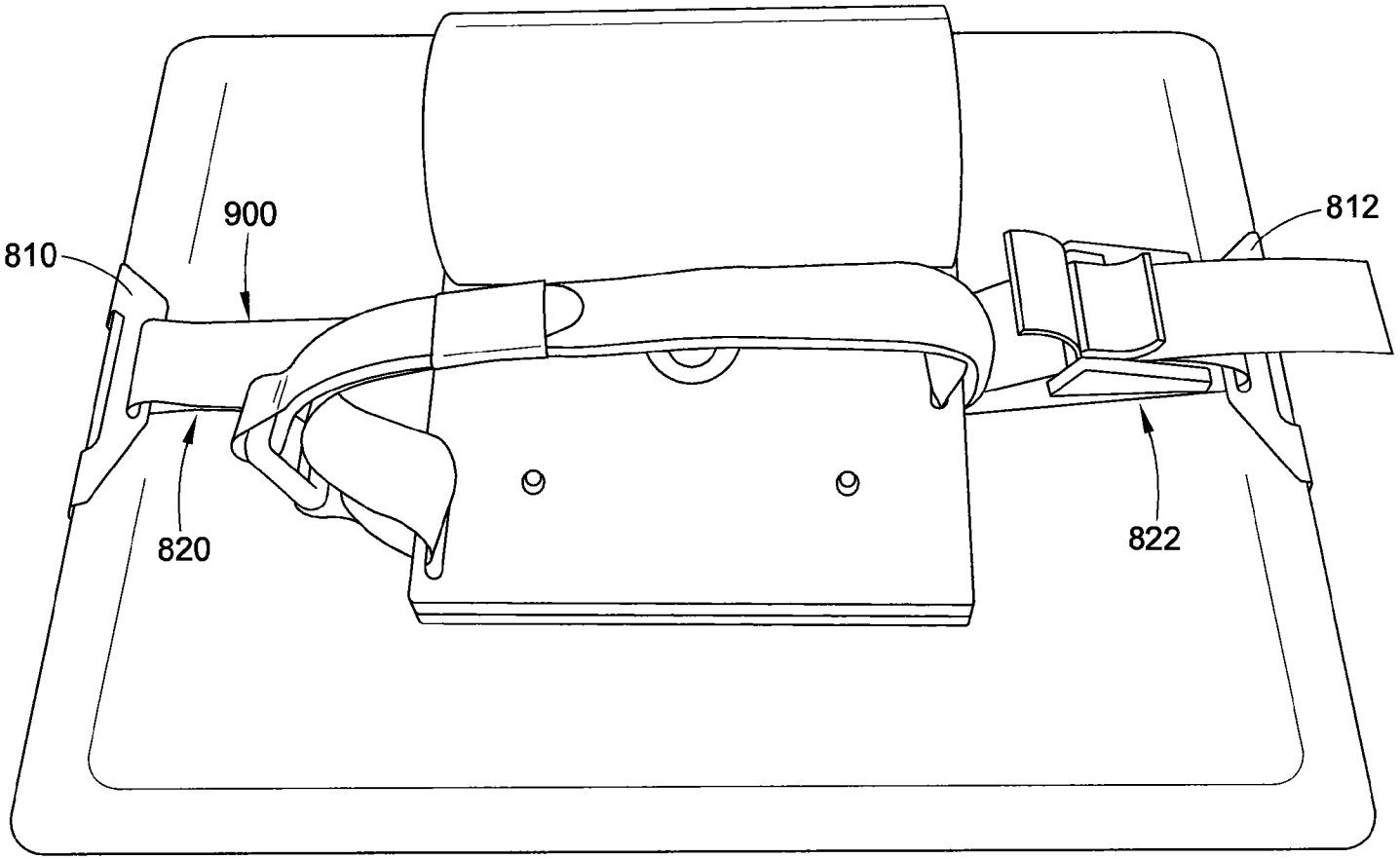
FIGS. 9*a* and 9*b* are rear perspective views of an attachment member of a grippable support apparatus in accordance with an example embodiment.
Figure 9B:
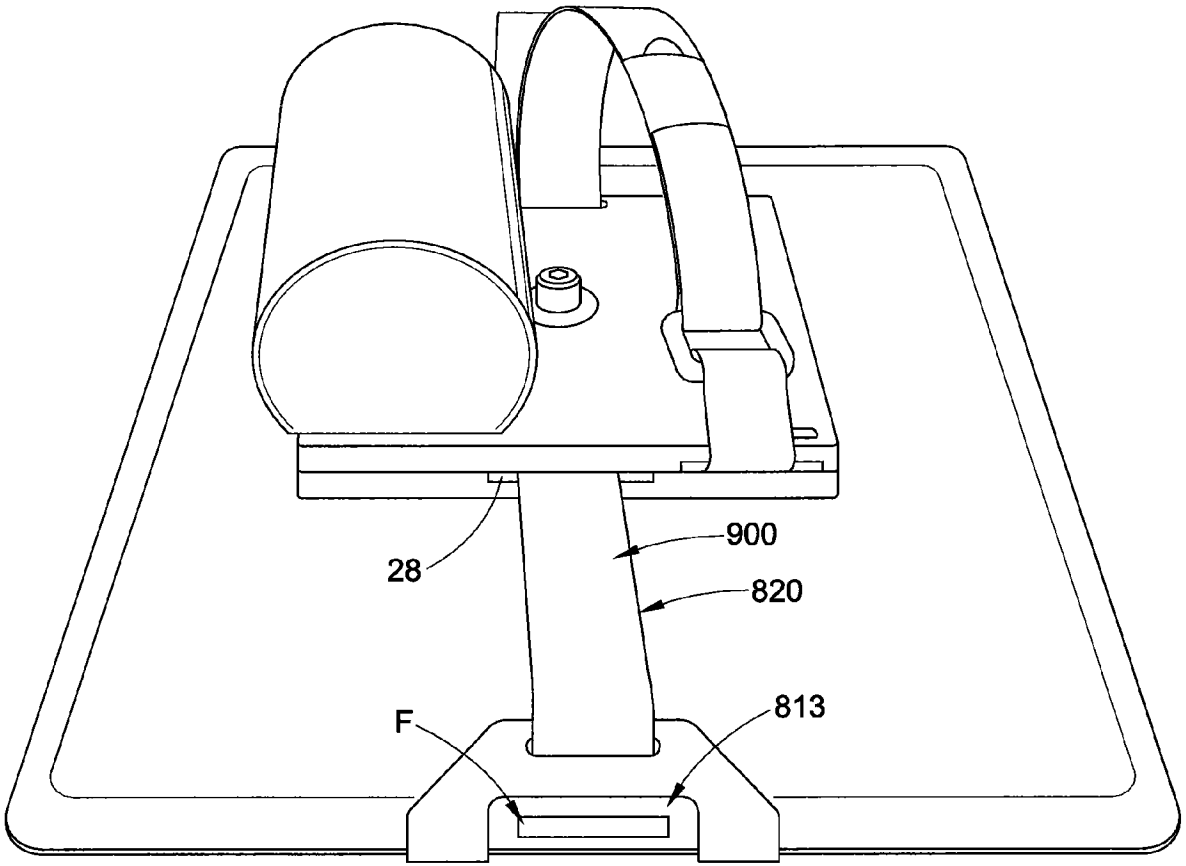

FIGS. 8*a* and 8*b* illustrate top and bottom views respectively, of an attachment member 800 in accordance with a further example embodiment. With reference now to those figures and with additional reference to FIGS. 9*a* and 9*b* showing the attachment member 800 installed on an associated tablet device A, the attachment member comprises at least two clip members 810, 812 operatively coupled with the base member 20. Each of the clip members 810, 812 is configured to engage an edge E on opposite sides of the associated tablet device A defined between the opposite front and rear substantially planar surfaces B, C of the tablet device. The first clip member 810 is coupled with the base member 20 by a first connector member 820. Similarly, the second clip member 812 is connected with the base member 20 by a second connector member 822. Each of the first and second connector members 820, 822 is configured to bias a one of the at least two clip members 810, 812 towards the base member 20, thereby drawing the clip members 810, 812 towards each other capturing the associated tablet device A therebetween. As shown best in FIG. 9*b*, the clip members preferably each define a gap 813 for enabling access to a charging port F or any other electrical connection ports as necessary or desired.

In the embodiment illustrated in FIGS. 8*a* and 8*b*, the first connector member 820 includes a belt member 830 formed of a material such as nylon for example, extending through a loop 814 formed in the clip member 810 and a further loop 24 formed in the base member 20. Similarly, the second connector member 822 comprises a second belt member 832 extending between a loop 816 formed in the second clip member 812 and a corresponding loop 26 formed in the base member 20. In the example embodiment, the first belt member 830 has a non-adjustable length and the second belt member 832 is adjustable using a buckle 834 or the like. However, it is to be appreciated that the first belt member 830 may also include a buckle member as necessary or desired to adjust the first belt member 830 relative to the loops 814, 814 of the clip member and base member, respectively. In that way, the belt members 830, 832 may be selectively adjustable to provide a selectively adjustable length for drawing the clip members 810, 812 mutually inwardly relative to the base member 20, thereby capturing and holding the associated tablet device therebetween.

In the example embodiment illustrated in FIGS. 9*a* and 9*b*, the first and second connector members 820, 822 comprise a continuous belt member 900 extending between the clip members 810, 812 through an opening 28 defined in the base member 20. The continuous belt member 900 has a selectively adjustable length provided by a buckle member 910 or the like for drawing the clip members 810, 812 mutually inwardly relative to the base member 20, thereby capturing and holding the associated tablet device A therebetween.

Figure 10:
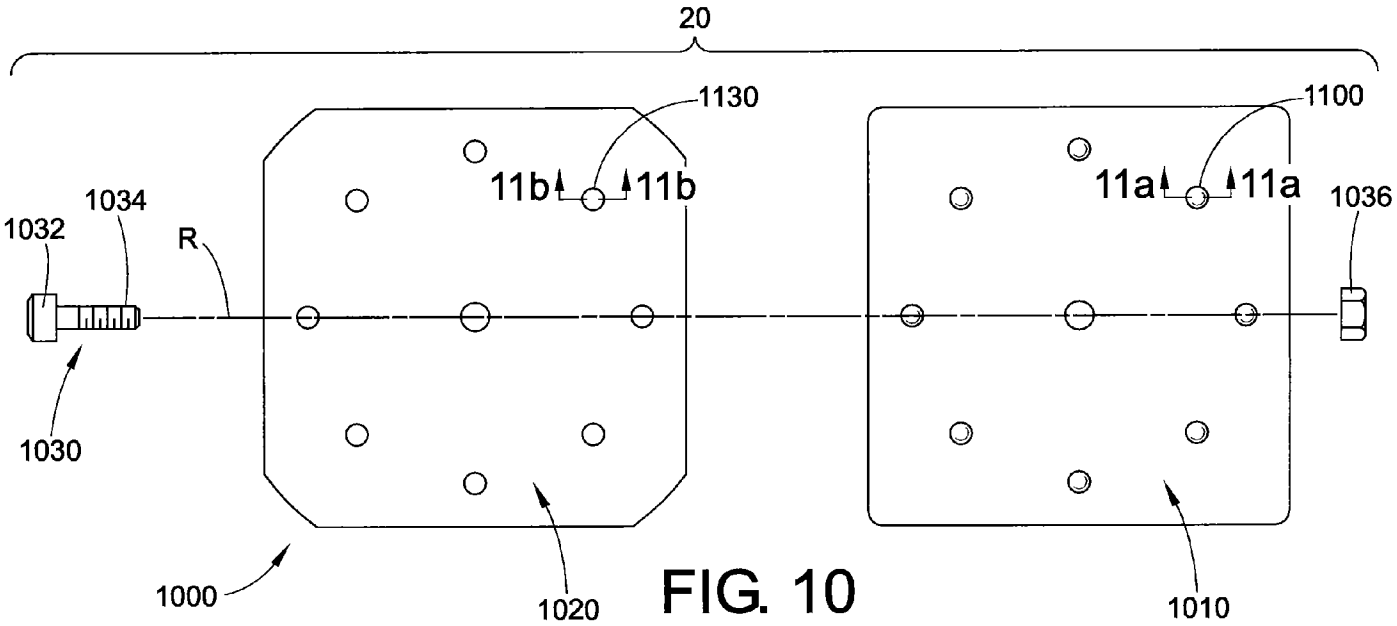
FIG. 10 is an exploded view of a base member of a grippable support apparatus in accordance with an example embodiment.

FIG. 10 illustrates a further embodiment of a base member 20 formed in accordance with an example enabling portions of the subject support apparatus 10 to rotatably move relative to other portions of the support apparatus thereby providing enhanced functionality of the embodiments. For example, in accordance with the base member 1000 shown in FIG. 10, the first interface member 40 may be moved relative to portions of the base member 1000 enabling the positioning of the tablet device A in the position shown in FIGS. 1 and 2, for example. In particular, the base member 1000 of the example embodiment comprises a first block member 1010 operatively coupled with the attachment member 30 (FIGS. 6-8) and a second block member 1020 operatively coupled with the first and second interface members 40, 50 (FIGS. 6, 8), and a joint member 1030 mutually coupling the first and second block members 1010, 1020. In the example embodiment, the joint member 1030 comprises a bolt member 1032 having a threaded end 1034 configured for mutual fastening with a nut member or the like 1036. The joint member 1030 supports the first and second block members 1010, 1020 for mutual relative rotation about an axis R. In its preferred form, the joint member supports the first and second block members 1010, 1020 for mutual rotation about the axis R extending substantially perpendicular to the rear substantially planar surface of the associated tablet device. In an embodiment the associated tablet device carried by the subject support system may be spun about the axis R while a portion of the subject support system is held by the user's hand to enable a fun and exciting rotating display of the content rendered on the screen of the device A.

Figure 11A:
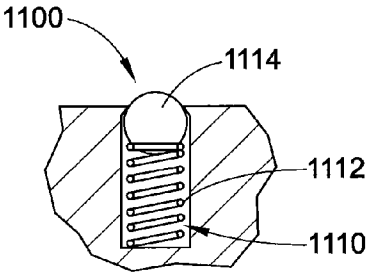
FIG. 11*a* is a cross-sectional view taken along line 11*a*-11*a* of FIG. 10.
Figure 11B:
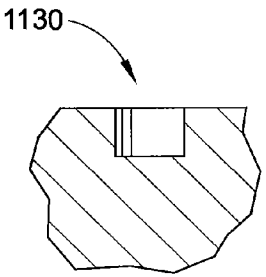
FIG. 11*b* is a cross-sectional view taken along line 11*b*-11*b* of FIG. 10.

In one form of the example embodiment, the first block member 1010 carried a plurality of spring loaded ball sets 1100 shown for example, in FIG. 11*a* disposed at selected positions on the first block member 1010. In the example embodiment illustrated, the spring loaded ball sets 1100 are disposed at 30 degree rotational increments. Each ball set 1100 includes a biasing member 1110 such as, for example, a spring 1112 urging a ball member 1114 into engagement with a corresponding detent, dimple, or pocket 1130 formed in the second block member 1020 such as shown, for example, in FIG. 11*b*. In this way, the first and second interface members 40, 50 carried on the second block member 1020 may be rotated relative to the first block member 1010 attached with the rear surface C of the associated tablet device A by the attachment member 30. As disclosed above, the attachment member may be any of the embodiments described above or others for mutually coupling the base member with the rear surface of the associated tablet device.

Figure 12:
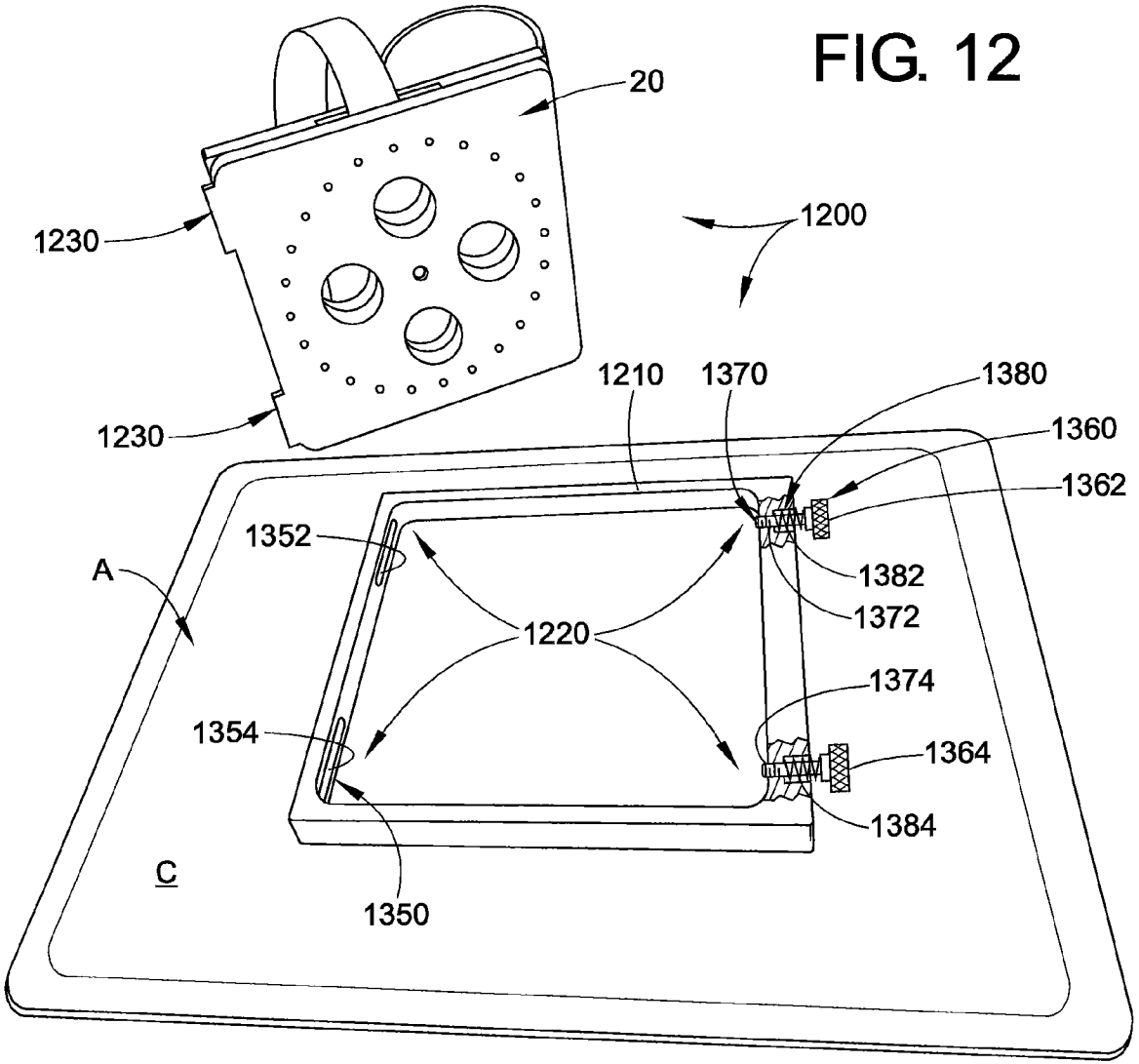
FIG. 12 is a side perspective view of a grippable support apparatus in accordance with an example embodiment illustrating the apparatus in a partially disconnected state.

An attachment member 1200 formed in accordance with a further example embodiment is illustrated in FIG. 12 wherein the attachment member 1200 includes a receiver member 1210 operatively coupled with the rear surface C of the associated tablet device A as shown. The receiver member 1210 may be coupled with the rear surface of the tablet device using any suitable means including, for example, those described above and may include, for example, an adhesive material such as adhesive tape, or the like. One form of adhesive tape that has been found to be particularly well-suited for the example embodiments herein is Very High Bond (VHB) available from 3M.

In the example embodiment, the attachment member 1200 includes first and second connectors 1220, 1230 arranged generally as shown. The first connector 1220 is selectively mutually connectable with the second connector 1230. It is to be appreciated that in the example embodiment, the first and second connectors 1220, 1230 are selectively mutually intermateable wherein the base member 20 carrying the user interface portion may be selectively attached and/or detached as necessary or desired. In the orientation illustrated in FIG. 12, the base member carrying the second connector 1230 is detached from the receiver member 1210 carrying the first connector 1220.

Figure 13:
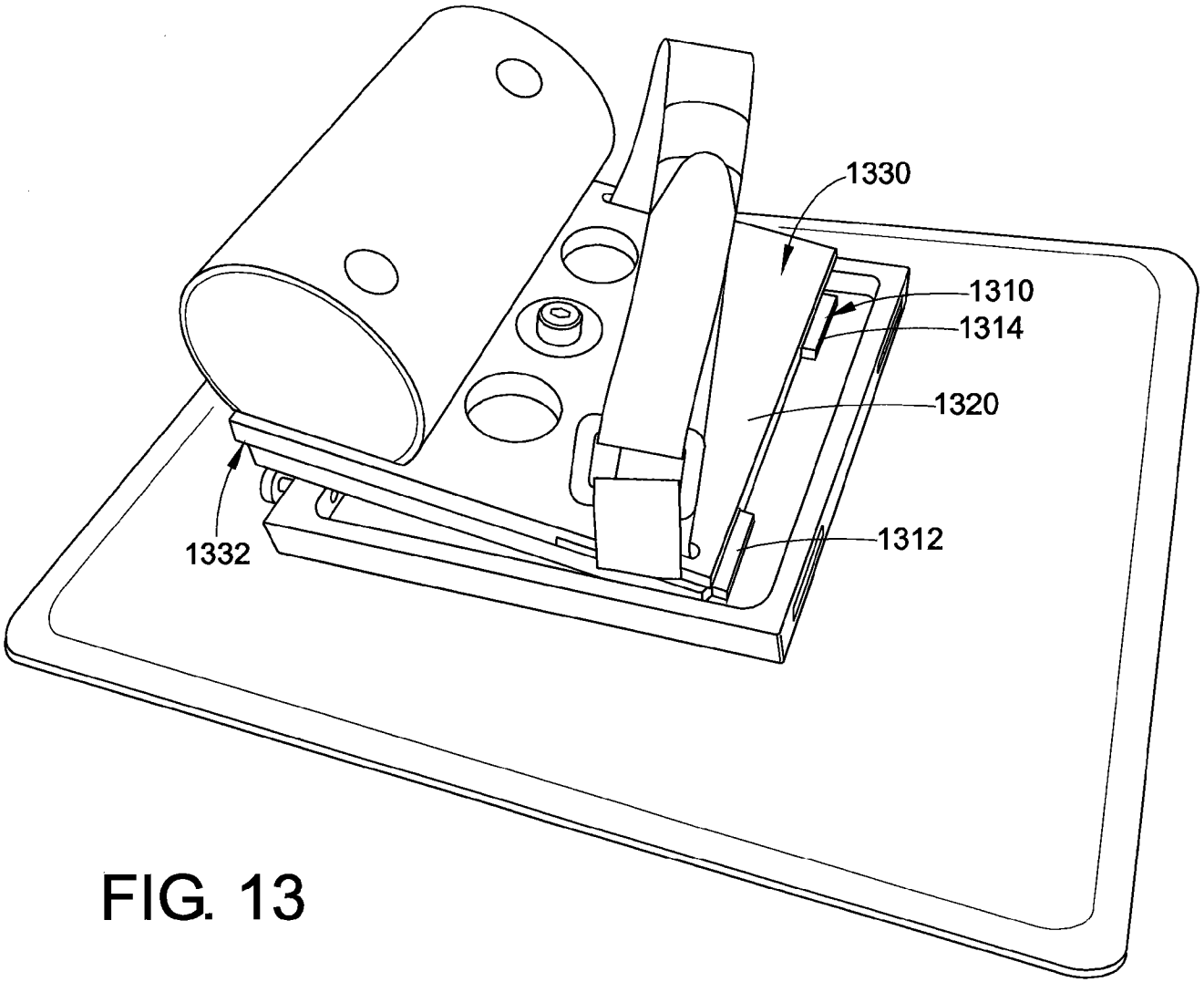
FIG. 13 is a side perspective view of the grippable support apparatus of FIG. 12 illustrated in an initial pre-connected state.
Figure 14:
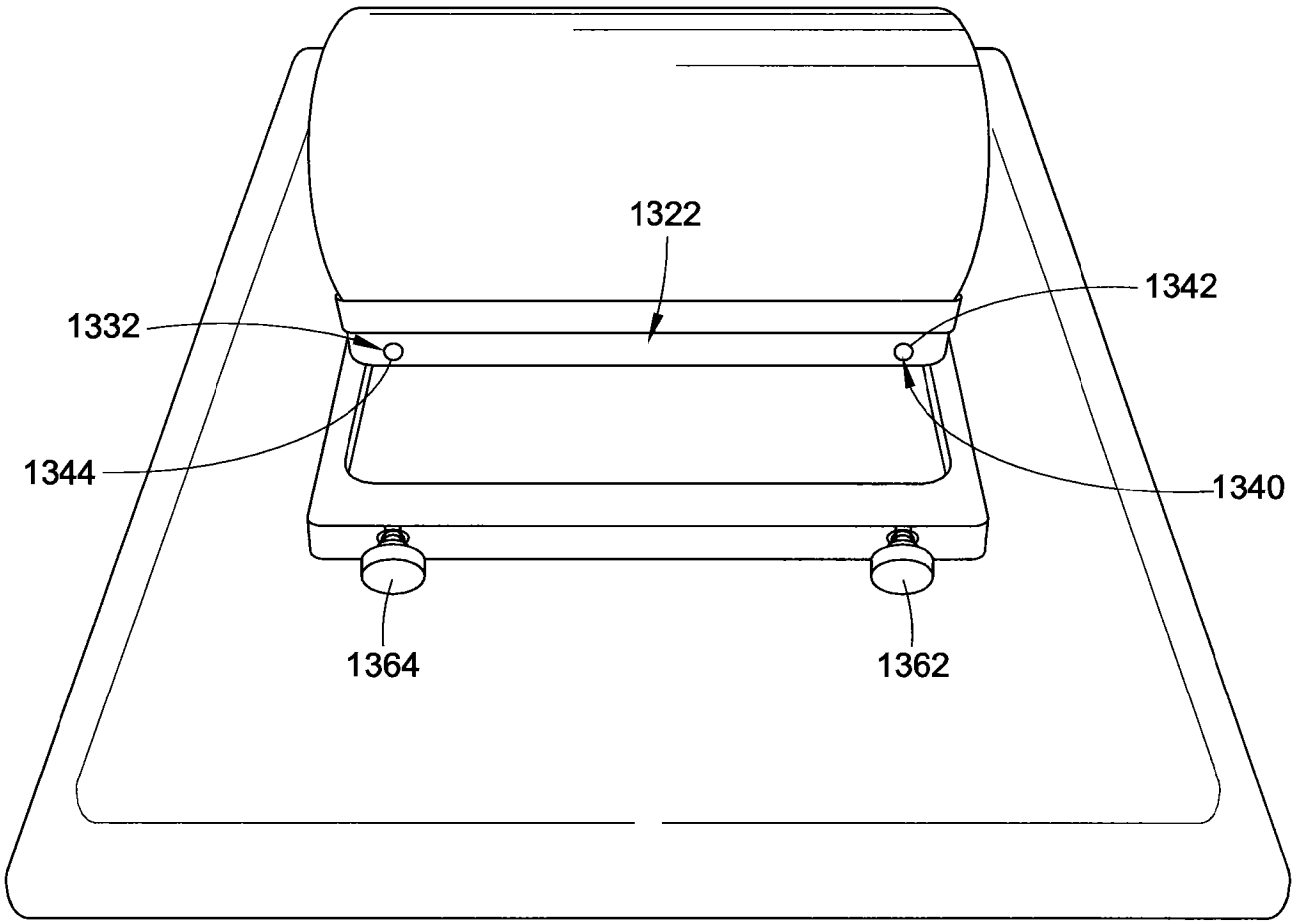
FIG. 14 is a side perspective view of the grippable support apparatus of FIGS. 12 and 13 illustrated in a second pre-connected state.

With continued reference to FIG. 12 but with additional reference to FIGS. 13 and 14, the second connector 1230 of the base member 20 includes in the example embodiment a cleat member 1310 extending from a first edge 1320 thereof on a first side 1330 of the base member 20, and a recess 1340 defined on a second edge 1322 thereof on a second side 1332 of the base member 20 opposite from the first side 1330. In the example embodiment illustrated, the cleat member 1310 includes separate first and second cleat members 1312, 1314 extending from the first edge 1320 of the base member as shown. However, it is to be appreciated that any number of separate cleat members can be equivalently used. In addition, in the embodiment illustrated, the recess 1340 includes a pair of spaced-apart recesses 1342, 1344 as shown. Again, it is to be appreciated that any one or more recesses may be provided as necessary or desired.

With continued reference to FIGS. 12-14, the first connector member 1220 of the receiver member 1210 includes in the example embodiment a slot 1350 configured to selectively receive the cleat member 1310 of the second connector 1230 of the base member 20. Additionally, the second connector 1220 includes a bolt member 1360 slideably carried by the first connector 1220, wherein the bolt member 1360 comprises a tip 1370 configured to be selectively received in the recess 1340 defined on the second edge 1322 of the base member 20. Still further, the first connector 1220 includes a biasing member 1380 configured to urge the bolt member 1360 towards the second connector 1230 for locating the tip 1370 in the recess 1340 of the second connector 1230.

In the example embodiment illustrated, a pair of separate spaced-apart slots 1352, 1354 are provided. It is to be appreciated, however, that any one or more slots 1350 may be used as necessary or desired. In addition, in the example embodiment, a pair of first and second bolt members 1362, 1364 are provided, each of the bolt members including a tip portion 1372, 1374 for engaging the recesses 1342, 1344 of the first connector 1220. Similarly, a pair of biasing members 1382, 1384 are provided for urging the bolt members 1362, 1364 relative to the first connector 1220 so that the tip portions 1370, 1372 thereof engage the recesses 1342, 1344 of the second connector 1230.

Figure 15:
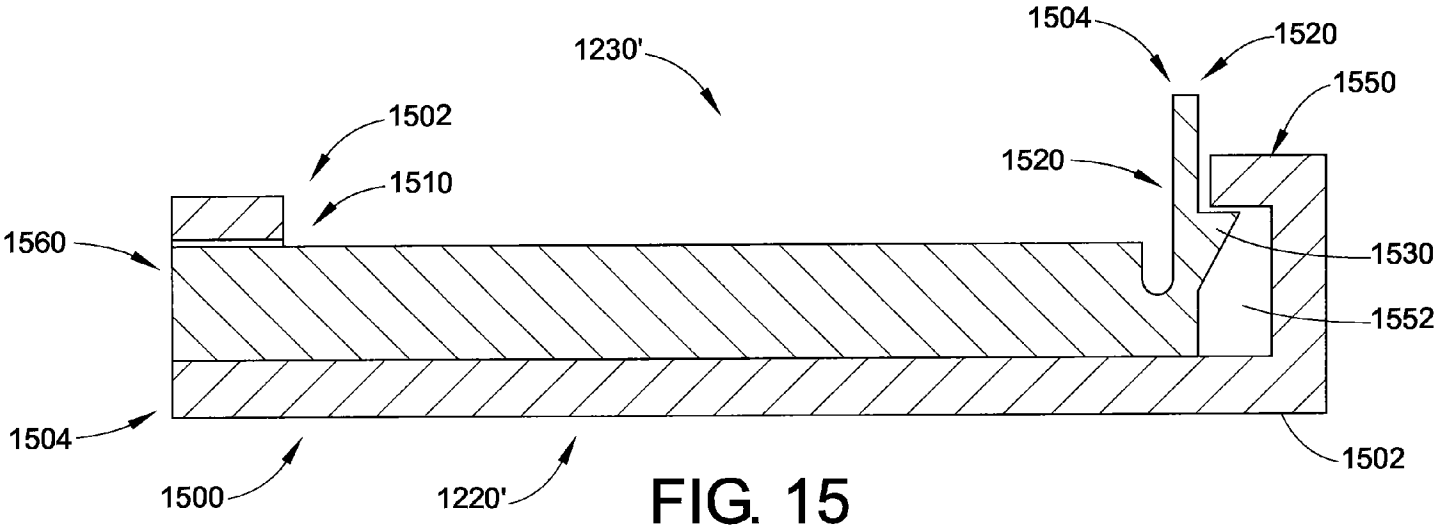
FIG. 15 is a cross-sectional view showing an attachment member of a grippable support apparatus in accordance with a further example embodiment.

With reference next to FIG. 15, a cross-section of an attachment means 1500 in accordance with a further example embodiment is shown. In the embodiment illustrated, the second connector 1230' includes a cleat member 1510 extending from a first edge thereof on a first side of the base member an arm member 1520 carried on a second edge thereof on a second side of the base member opposite from the first side, wherein the arm member 1520 is biased outwardly relative to the second connector 1230' in a direction from the first side 1502 of the base member towards the second side 1504 of the base member. Further, the second connector member 1230' includes a latch member 1530 carried on the arm member 1520 and a lever 1540 carried on an end of the arm member 1520. The arm member 1520 is selectively moveable inwardly by the thumb of a user operating the lever so that the latch member 1530 may selectively disengage a catch member 1550 of the first connector member 1220'. In particular, in the embodiment illustrated, the first connector 1220' includes a slot 1560 configured to selectively receive the cleat member 1510 of the second connector 1230'. The catch member 1550 defines a recess 1552 configured to selectively receive the latch member 1530 of the second connector member 1230'.

In the embodiment illustrated, the second connector 1230' is preferably made of a resilient material such as, for example, plastic or the like. In addition, the first connector 1220' may be made from any suitable materials including, for example, aluminum, plastic, or the like.

Figure 16:
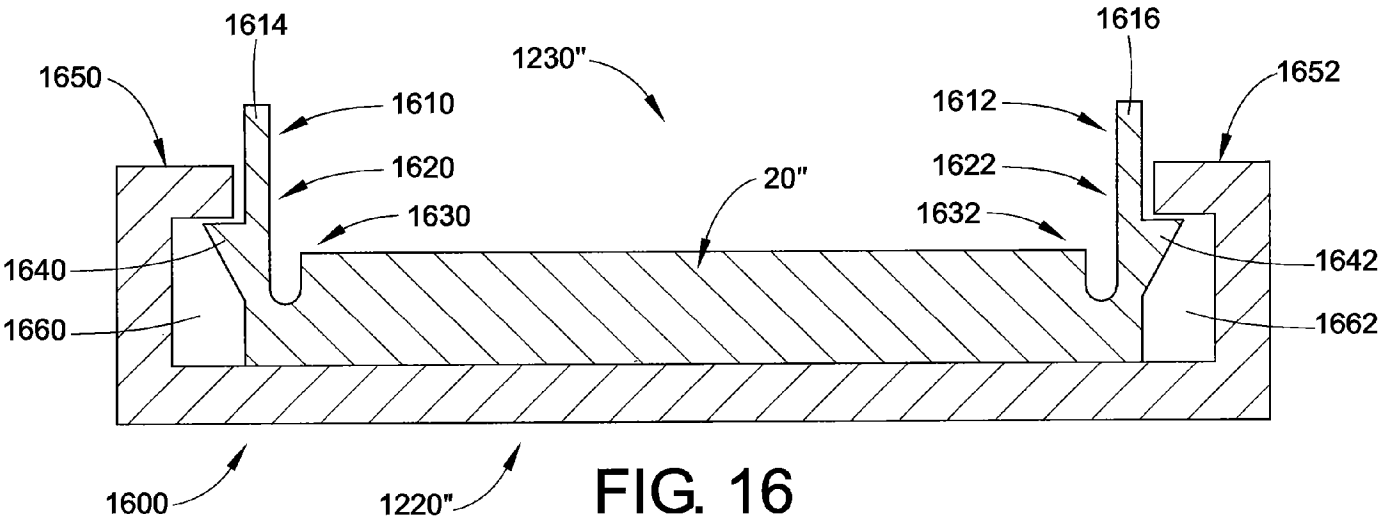
FIG. 16 is a cross-sectional view illustrating an attachment member of a grippable support apparatus in accordance with a still further example embodiment.

A further embodiment of an attachment means 1600 is illustrated in FIG. 16. In this example embodiment, the second connector 1230" includes a first arm member 1610 carried on a first edge 1620 thereof on a first side 1630 of the base member 20", wherein the first armed member 1610 comprises a first latch member 1640 biased outwardly relative to the base member 20". Similarly, the second connector member 1230" includes a second arm member 1612 carried on a second edge 1622 thereof on a second side 1632 of the base member 20" opposite from the first side 1630 of the base member, wherein the second arm member 1612 comprises a second latch member 1642 biased outwardly relative to the base member 20".

The first connector 1220" of the attachment mechanism 1600 illustrated in FIG. 16 includes a first catch member 1650 defining a first recess 1660 configured to selectively receive the first latch member 1640 of the second connector member 1230". Correspondingly, the first connector 1220" further includes a second catch member 1652 defining a second recess 1662 configured to selectively receive the second latch member 1642 of the second connector member 1230". In the embodiment, each of the first and second arm members 1610, 1612 include or otherwise define a lever 1614, 1616 respectively, carry on ends thereof, wherein the arm members 1610, 1612 are selectively moveable inwardly by a user operating the levers 1614, 1616, respectively. It is to be appreciated that the second connector 1230" of the attachment mechanism 1600 illustrated in the example embodiment may be formed of any suitable material including, for example, plastic or the like.

The example embodiments herein have been described with reference to preferred structures, shapes, and conformations. However, it is to be appreciated that the claims herein are not limited to those precise structures or their specific descriptions. Rather, the claims are to be given their broadest possible interpretation as appropriate.

In addition, while certain embodiments have been described, these embodiments have been presented by way of example only, and are not intended to limit the scope of the claimed inventions. Indeed, the novel embodiments described herein may be embodied in a variety of other forms; furthermore, various omissions, substitutions, and changes in the form of the embodiments described herein may be made without departing from the spirit of the claimed invention.

Figure 17B:
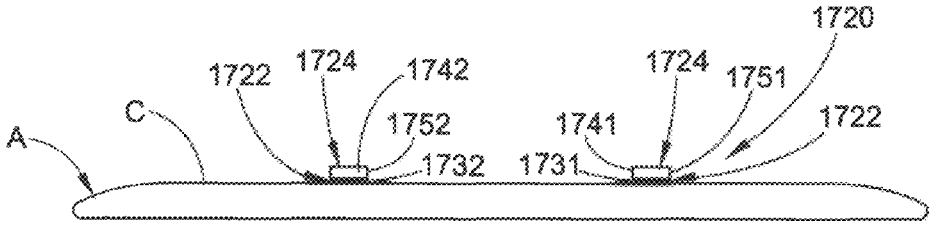
FIG. 17*b* is a side elevational view of the components of the attachment member of FIG. 17*a* taken along line 17*b*-17*b* in FIG. 17*a*.
Figure 17A:
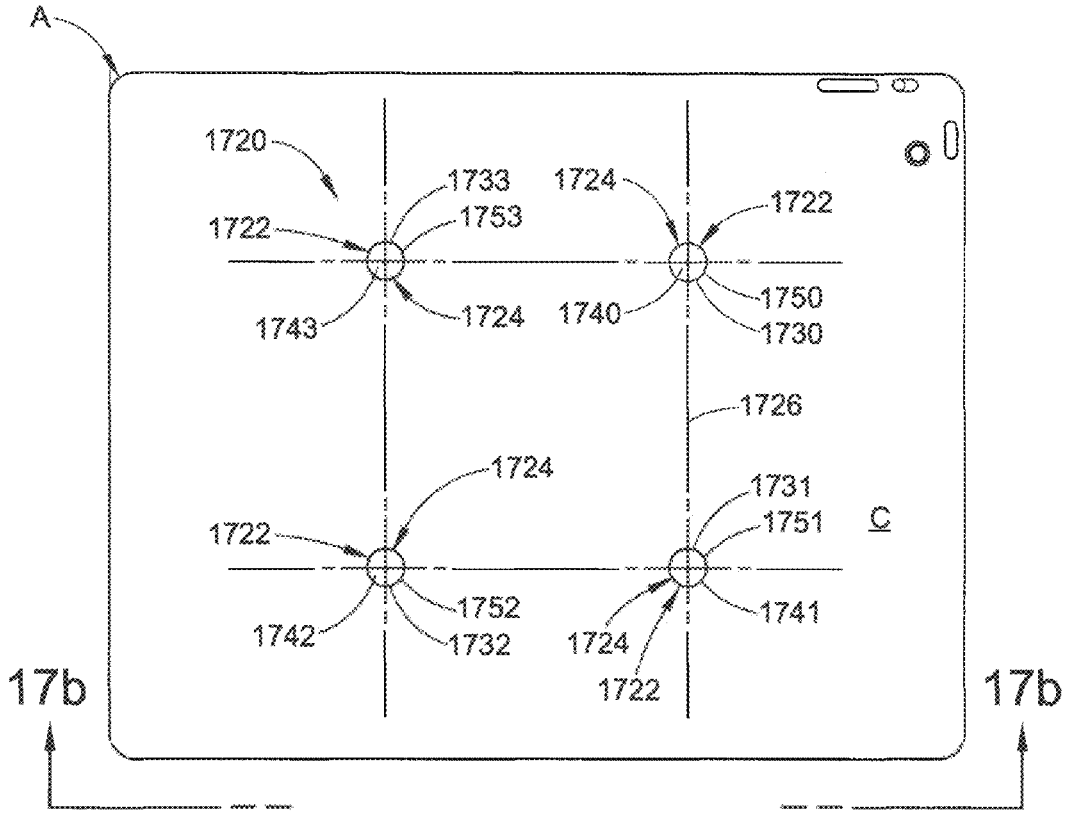
FIG. 17*a* is a rear plan view of components of an attachment member of a grippable support apparatus in accordance with a still further example embodiment.

With reference now to FIGS. **17*a*-19, further example attachment and base member embodiments will be described. As shown in FIGS. 17*a* and 17*b*, the attachment member 1720 includes a plurality of adhesive portions 1722 and a corresponding plurality of coupling portions 1724. The adhesive portions 1722 include a set of four (4) adhesive tape members 1730, 1731, 1732, and 1733. In the environment illustrated, each of the adhesive tape members 1730-1733 are disposed at opposite corners of a virtual square 1726 defined on the rear surface of the associated tablet device. It is to be appreciated, however, that any number of adhesive tape members 1730** can be used and/or arranged as necessary or desired in order to provide adequate support of the base member of the subject support system relative to the associated tablet device.

With continued reference to FIGS. **17*a* and 17*b*, the attachment member 1720 further includes a set of coupling portions 1724 as described. The coupling portions 1724 are disposed on the rear surface C of the associated tablet device A and are preferably arranged to be coincident with the adhesive portions 1722. In this regard, the coupling portions 1724 of the example embodiment include a set of four (4) magnetic members 1740, 1741, 1742, and 1743. In the example embodiment illustrated, the coupling portions 1724 are sized to correspond to the selected size of the adhesive portions 1722. However, it is to be appreciated that the relative size and/or proportions of the coupling and adhesive portions relative to each other can be modified as necessary or desired. In any case, in the embodiment, the adhesive portions 1722 affix and otherwise attach the coupling portions 1724** with the rear surface C of the associated tablet device.

The attachment member 1720 of the example embodiment is configured to selectively couple with an associated base member portion 1820 having a general conformation as illustrated in FIGS. **18*a* and 18*b*. Turning now to those figures, the base member portion 1820 has a generally rectangular conformation and includes a set of recessed portions 1822 configured to receive a corresponding set of coupling members 1824. In the embodiment illustrated, the rectangular base member portion 1820 is preferably a square rectangle and, accordingly, defines a set of four (4) corners. Each of the corners of the base member portion 1820 is provided with a recess portion and corresponding coupling member as illustrated. In this regard, a set of four (4) recesses 1830, 1831, 1832 and 1833 are defined in the base member portion 1820 as shown. Further in the example embodiment, each of the recesses 1830-1833 is configured to receive a corresponding coupling member 1840, 1841, 1842 and 1843. In the example embodiment, the coupling members 1840-1843 are shaped to correspond with the general shape of the recesses 1830-1833 so that the coupling members may be securely received therein. In the example embodiment, each of the coupling members 1840-1843 are magnetic members for a mutual magnetic coupling of the magnetic members 1740-1743 of the attachment member 1720 described above in connection with FIGS. 17***a* and 17*b*.

Figure 18B:
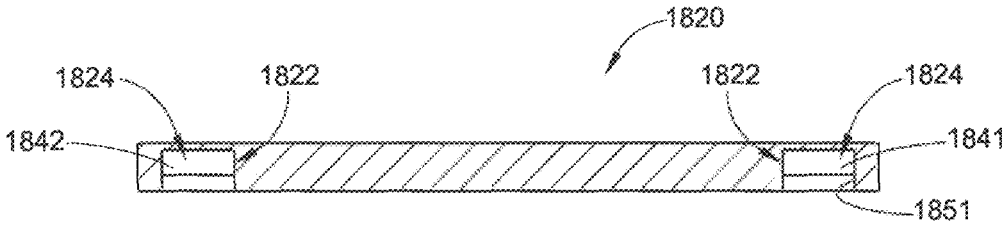
FIG. 18*b* is a side elevational view of the further components of the attachment member of FIGS. 18*a*, 17*a*, and 17*b* taken along line 18*b*-18*b* of FIG. 18*a*.
Figure 18A:
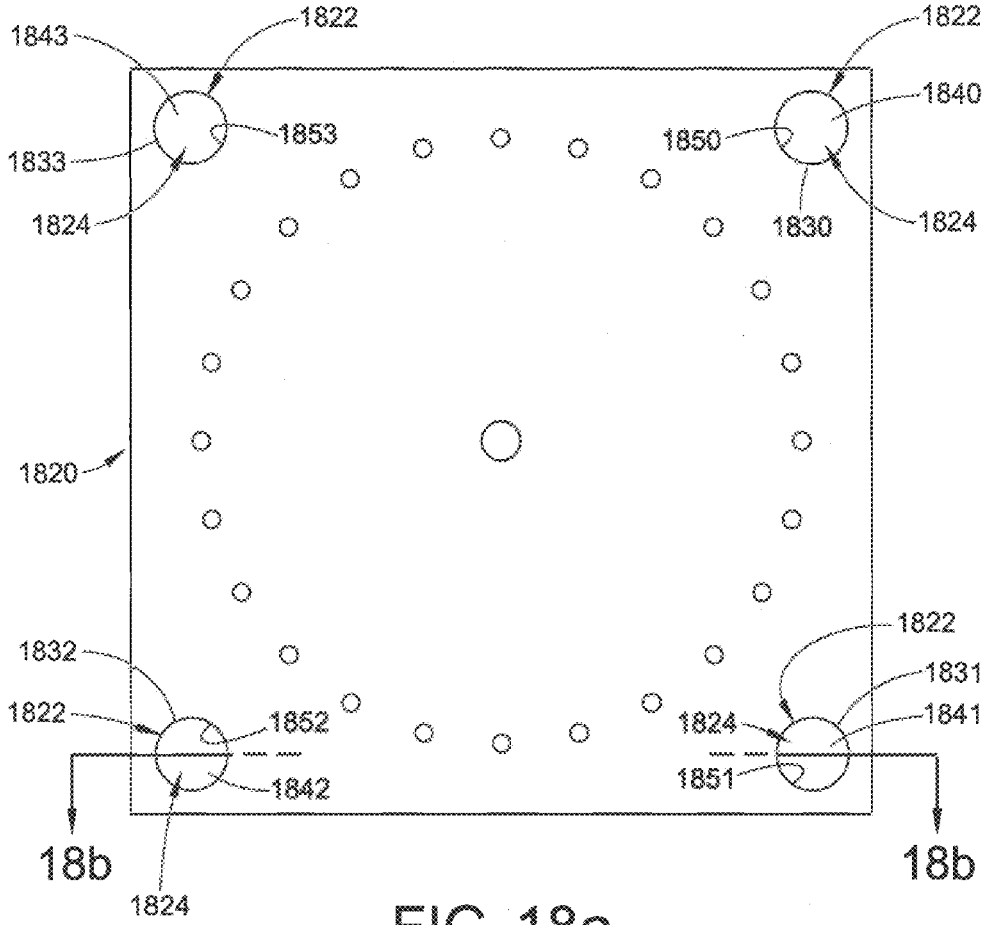
FIG. 18*a* is a plan view of further components of the attachment member illustrated in FIGS. 17*a* and 17*b*.
Figure 19:
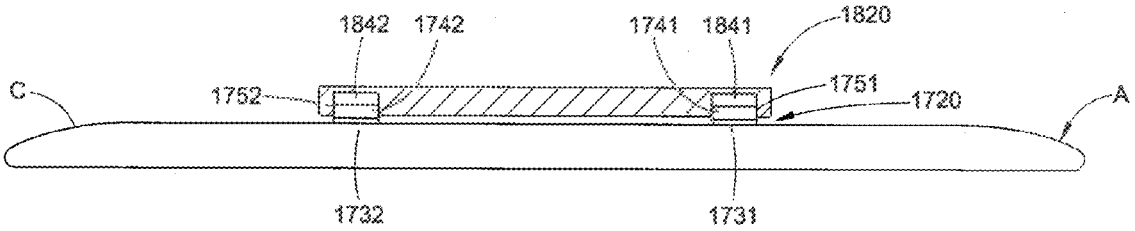
FIG. 19 is a side elevational view of the attachment member illustrated in FIGS. 17*a* to 18*b* shown in an assembled condition.

FIG. 19 shows the base member portion 1820 (FIGS. 18*a* and 18*b*) received on the attachment member 1720 (FIGS. 17*a* and 17*b*) in a mutually coupled orientation. As shown, the coupling members 1840-1843 of the base member portion 1820 are in mutual butted engagement with the magnetic members 1740-1743 of the attachment member 1720. In this regard, it is to be appreciated that the arrangement of spacing between the recesses 1830-1833 of the base member portion 1820 are made to correspond with the locations and arrangement of the magnetic members 1740-1743 of the attachment member 1720.

In addition to the above, it is to further be appreciated that, in the example embodiment, the magnetic coupling members 1840-1843 of the base member portion 1820 as well as the magnetic members 1740-1743 of the attachment member 1720 are preferably formed of rare earth disc magnetics. In that way, a strong mutual attraction is created for generating a secure coupling between the base member portion 1820 and the attachment member 1720. Yet still further, a mechanical engagement is provided in the example embodiment between inner surfaces 1850-1853 of the recesses 1830-1833 of the base member portion 1820 in corresponding loose contact with outer surfaces 1750-1753 (FIG. 17*a*) of the magnetic members 1740-1743 of the attachment member 1720. More particularly, in the example embodiment, the magnetic members 1740-1743 have a substantially circular confirmation with an outer diameter being slightly less than an inner diameter of the recesses 1830-1833 of the base member portion 1820.

In the example embodiment, the base member portion 1820 may be mutually coupled with any one or more of the components described above including, for example, any of the base member embodiments and/or any of the user interface portions for providing a support system for associated digital tablet devices.

The invention claimed is:

1. A grippable support apparatus for use with an associated tablet device having a generally rectangular conformation with opposite front and rear substantially planar surfaces, the apparatus comprising:

a base member;

an attachment member configured to selectively attach the base member with the rear substantially planar surface of the associated tablet device, the attachment member comprising a receiver member operatively coupled with the rear substantially planar surface of the associated tablet device, and a first connector; and a user interface portion operatively coupled with the base member and configured to engage a hand of a user of the grippable support apparatus, wherein the interface portion adapts the grippable support apparatus to be carried by the hand of the user and selectively props the associated tablet device in one or more selected orientations relative to an associated work surface when not being carried by the hand of the user, wherein the base member comprises a second connector selectively intermateable with the first connector, wherein the user interface portion operatively coupled with the base member may be selectively i) detached from the receiver member, and ii) attached with the receiver member by the first and second connectors.

2. The grippable support apparatus according to claim 1, wherein the interface portion comprises:

a first interface member operatively coupled with the base member, the first interface member being configured to engage a ventral side of the hand of a user of the grippable support apparatus; and a second interface member operatively coupled with the base member, the second interface member being configured to engage a dorsal side of the hand of the user of the grippable support apparatus.

3. The grippable support apparatus according to claim 2, wherein:

the first interface member comprises an elongate cylindrical member coupled with the base member and configured to be gripped by the palm of the hand of the user of the apparatus; and the second interface member comprises an elongate band member coupled with the base member and configured to surround the dorsal side of the hand of the user of the apparatus, and to secure the hand of the user between the elongate band member and the elongate cylindrical member.

4. The grippable support apparatus according to claim 3, wherein:

the elongate cylindrical member defines a longitudinal axis; and the elongate cylindrical member is coupled with the base member with the longitudinal axis extending substantially in parallel with a plane defined by the planar rear surface of the associated tablet device.

5. The grippable support apparatus according to claim 4, wherein:

the elongate cylindrical member is an elongate circular cylindrical member; and the elongate band member is a strap member having an adjustable length.

6. The grippable support apparatus according to claim 3, further comprising:

a foot member carried on the elongate cylindrical member, the foot member being configured to engage the associated work surface supporting the associated tablet device propped relative to the associated work surface by the user interface portion.

7. The grippable support apparatus according to claim 6, wherein the foot member is a rubber pad.

8. The grippable support apparatus according to claim 1, wherein:

the attachment member comprises at least one suction cup member operatively coupled with the base member, the at least one suction cup member being configured to selectively attach the base member with the rear substantially planar surface of the associated tablet device.

9. The grippable support apparatus according to claim 1, wherein:

the attachment member comprises an adhesive member operatively coupled with the base member, the adhesive member being configured to selectively attach the base member with the rear substantially planar surface of the associated tablet device.

10. The grippable support apparatus according to claim 1, wherein:

the attachment member comprises a magnetic member operatively coupled with the base member, the magnetic member being configured to selectively attach the base member with the rear substantially planar surface of the associated tablet device.

11. The grippable support apparatus according to claim 1, wherein:

the attachment member comprises at least two clip members operatively coupled with the base member, each of the at least two clip members being configured to engage an edge on opposite sides of the associated tablet device defined between the opposite front and rear substantially planar surfaces of the associated tablet device.

12. The grippable support apparatus according to claim 1, wherein:

the second connector comprises i) a cleat member extending from a first edge thereof on a first side of the base member, and ii) a recess defined on a second edge thereof on a second side of the base member opposite from the first side of the base member; and the first connector comprises i) a slot configured to selectively receive the cleat member of the second connector member of the base member; ii) a bolt member slideably carried by the first connector member, the bolt member comprising a tip configured to be selectively received in the recess defined on the second edge of the base member; and iii) a biasing member configured to urge the bolt member towards the second connector for locating and holding the tip in the recess of the second connector member.

13. The grippable support apparatus according to claim 1, wherein:

the second connector member comprises i) a cleat member extending from a first edge thereof on a first side of the base member; ii) an arm member carried on a second edge thereof on a second side of the base member opposite from the first side of the base member, wherein the arm member is biased outwardly relative to the second connector member in a direction from the first side of the base member towards the second side of the base member; iii) a latch member carried on the arm member; and iv) a lever carried on an end of the arm member, wherein the arm member is selectively moveable inwardly by a user operating the lever; and the first paragraph comprises i) a slot configured to selectively receive the cleat member of the second connector member of the base member, and ii) a catch member defining a recess configured to selectively receive the latch member of the second connector member thereby selectively holding the base member relative to the receiver member.

14. The grippable support apparatus according to claim 1, wherein:

the second connector member comprises i) a first arm member carried on a first edge thereof on a first side of the base member, wherein the first arm member comprises a first latch member biased outwardly relative to the base member, and ii) a second arm member carried on a second edge thereof on a second side of the base member opposite from the first side of the base member, wherein the second arm member comprises a second latch member biased outwardly relative to the base member; and the first connector comprises i) a first catch member defining a first recess configured to selectively receive the first latch member of the second connector member, and ii) a second catch member defining a second recess configured to selectively receive the second latch member of the second connector member.

15. A grippable support apparatus for use with an associated tablet device having a generally rectangular conformation with opposite front and rear substantially planar surfaces, the apparatus comprising:

a base member;

an attachment member configured to selectively attach the base member with the rear substantially planar surface of the associated tablet device, the attachment member comprising:

at least two clip members operatively coupled with the base member, each of the at least two clip members being configured to engage an edge on opposite sides of the associated tablet device defined between the opposite front and rear substantially planar surfaces of the associated tablet device;

a first connector member coupling a first clip member of the at least two clip members with the base member; and, a second connector member coupling a second clip member of the at least two clip members with the base member; wherein, at least one of the first and second connector members is configured to bias a one of the at least two clip members towards the base member thereby mutually drawing the at least two clip members towards each other thereby capturing and holding the associated tablet device therebetween; and a user interface portion operatively coupled with the base member and configured to engage a hand of a user of the grippable support apparatus, wherein the interface portion adapts the grippable support apparatus to be carried by the hand of the user and selectively props the associated tablet device in one or more selected orientations relative to an associated work surface when not being carried by the hand of the user.

16. The grippable support apparatus according to claim 15, wherein:

the first and second connector members comprise a continuous belt member extending between the at least two clip members, the continuous belt member being operatively coupled with the base member.

17. The grippable support apparatus according to claim 16, wherein:

the belt member has a selectively adjustable length for drawing the at least two clip members mutually inwardly relative to the base member, thereby capturing and holding the associated tablet device therebetween.

18. A grippable support apparatus for use with an associated tablet device having a generally rectangular conformation with opposite front and rear substantially planar surfaces, the apparatus comprising:

a base member;

an attachment member configured to selectively attach the base member with the rear substantially planar surface of the associated tablet device; and a user interface portion operatively coupled with the base member and configured to engage a hand of a user of the grippable support apparatus, wherein the interface portion adapts the grippable support apparatus to be carried by the hand of the user and selectively props the associated tablet device in one or more selected orientations relative to an associated work surface when not being carried by the hand of the user, wherein the base member comprises: a first block member operatively coupled with the attachment member; a second block member operatively coupled with the user interface portion; and a joint member mutually coupling the first and second block members.

19. The grippable support apparatus according to claim 18, wherein:

the joint member supports the first and second block members for mutual relative rotation about an axis.

20. The grippable support apparatus according to claim 19, wherein:

the joint member supports the first and second block members for mutual relative rotation about the axis extending substantially perpendicular to a plane defined by the substantially planar rear surface of the associated tablet device.

21. The grippable support apparatus according to claim 18, wherein the interface portion comprises:

a first interface member operatively coupled with the base member, the first interface member being configured to engage a ventral side of the hand of a user of the grippable support apparatus; and a second interface member operatively coupled with the base member, the second interface member being configured to engage a dorsal side of the hand of the user of the grippable support apparatus.

22. The grippable support apparatus according to claim 21, wherein:

the first interface member comprises an elongate cylindrical member coupled with the base member and configured to be gripped by the palm of the hand of the user of the apparatus; and the second interface member comprises an elongate band member coupled with the base member and configured to surround the dorsal side of the hand of the user of the apparatus, and to secure the hand of the user between the elongate band member and the elongate cylindrical member.

23. The grippable support apparatus according to claim 22, wherein:

the elongate cylindrical member defines a longitudinal axis; and the elongate cylindrical member is coupled with the base member with the longitudinal axis extending substantially in parallel with a plane defined by the planar rear surface of the associated tablet device.

24. The grippable support apparatus according to claim 23, wherein:

the elongate cylindrical member is an elongate circular cylindrical member; and the elongate band member is a strap member having an adjustable length.

25. The grippable support apparatus according to claim 22, further comprising:

a foot member carried on the elongate cylindrical member, the foot member being configured to engage the associated work surface supporting the associated tablet device propped relative to the associated work surface by the user interface portion.

26. The grippable support apparatus according to claim 25, wherein the foot member is a rubber pad.

27. The grippable support apparatus according to claim 18, wherein:

the attachment member comprises at least one suction cup member operatively coupled with the base member, the at least one suction cup member being configured to selectively attach the base member with the rear substantially planar surface of the associated tablet device.

28. The grippable support apparatus according to claim 18, wherein:

the attachment member comprises an adhesive member operatively coupled with the base member, the adhesive member being configured to selectively attach the base member with the rear substantially planar surface of the associated tablet device.

29. The grippable support apparatus according to claim 18, wherein:

the attachment member comprises a magnetic member operatively coupled with the base member, the magnetic member being configured to selectively attach the base member with the rear substantially planar surface of the associated tablet device.

* * * * *